US005941431A

United States Patent [19]

Parker

[11] Patent Number: 5,941,431

[45] Date of Patent: Aug. 24, 1999

[54] SOCK BOARDING APPARATUS

[75] Inventor: Jeffrey W. Parker, Old Fort, N.C.

[73] Assignee: Threadbear, LLC, Old Fort, N.C.

[21] Appl. No.: 09/097,647

[22] Filed: Jun. 16, 1998

Related U.S. Application Data

[63] Continuation-in-part of application No. 08/854,949, May 13, 1997.

[51] Int. Cl.[6] ..... A47G 25/90; D09C 5/00

[52] U.S. Cl. ..... 223/112; 223/75; 223/77

[58] Field of Search ..... 223/112, 75, 77

[56] References Cited

U.S. PATENT DOCUMENTS

| | | | |
|---|---|---|---|
| 1,466,868 | 9/1923 | Witherell . | |
| 1,777,705 | 10/1930 | Stetten . | |
| 2,842,298 | 7/1958 | Hill . | |
| 3,096,006 | 7/1963 | Glaze, Jr. . | |
| 3,319,851 | 5/1967 | Horberg, Jr. | 223/112 |
| 3,520,262 | 7/1970 | Bolles et al. . | |
| 4,401,244 | 8/1983 | Selvi et al. . | |
| 4,434,918 | 3/1984 | Hodges . | |
| 4,564,133 | 1/1986 | Gazzarrini . | |
| 4,703,877 | 11/1987 | Kuniki et al. . | |
| 4,903,415 | 2/1990 | Cortese . | |
| 5,651,483 | 7/1997 | Bell et al. | 223/112 |

*Primary Examiner*—Bibhu Mohanty

*Attorney, Agent, or Firm*—Kennedy Covington; Lobdell & Hickman, LLP

[57] ABSTRACT

An apparatus for boarding socks includes a skeletal frame formed from a plurality of subframes define a path of movement for one or more socks being boarded by the apparatus, an assembly for boarding one or more socks including an assembly for moving a sock board into one or more socks, an assembly for positioning one or more socks for engagement by the sock form, and an assembly for delivering one or more socks to the positioning assembly.

53 Claims, 34 Drawing Sheets

SOCK BOARDING APPARATUS

BACKGROUND OF THE INVENTION

This is a continuation-in-part of U.S. patent application Ser. No. 08/854,949, May 13, 1997 for SOCK BOARDING APPARATUS now abandoned.

The present application relates broadly to machines for processing and finishing knitted products such as underwear, gloves, or socks and, more particularly, to an apparatus for boarding just-knitted socks for further manufacturing steps. Socks are typically knitted in a circular knitting machine, there undergoing the knitting process which transforms yarn into socks. After the knitting process, further processes or steps are necessary prior to shipping the product to retailers including clipping loose strands, label printing, pressing, and pairing. Currently, a sock or multiple socks are typically placed on a sock form, known as a board, which is a foot-shaped, generally flat member on which the sock is placed for processing. The board forces the sock into a disposition wherein a toe, body, heel, and leg portion are defined.

Typically, a sock finishing machine will have several boards arranged in some array wherein a processing machine will present consecutive boards for sock placement.

Currently, socks are placed on the boards by hand, which is a labor intensive operation requiring rapid, repetitive accurate movement. In order to proper board a sock, the sock must be positioned correctly with the toe portion over the toe portion of the board and pulled taut over the board for further processing. Since the manufacture of the sock is automated, and since further processing of the sock is automated, the person boarding the socks is placed in the unenviable position of being between two machines. The socks must be boarded at a pace that will keep up with the output of the production machine and keep up with the demand of the downstream machines provided for further processing. Further, the position of the socks on the board should be consistent throughout the consecutive array of socks leaving the knitting machine for boarding. The stress level for a person boarding socks under these conditions may be great. The speed required by the machines, in combination with the positioning requirements, create a difficult situation which is exacerbated by the relentless, unyielding demand of the machines. Clearly, this manual process requires automation. However, the process does not easily lend itself to automation due to the manual dexterity required by the flexibility of the socks in combination with the ability to align the socks on the form which requires sight and judgment, qualities not typically associated with machines.

There is therefore a need for a machine which will properly align the socks on the form for rapid boarding of consecutive socks.

SUMMARY OF THE INVENTION

It is accordingly an object of the present invention to provide an apparatus for boarding socks in order to automate a current manual process.

It is another object of the present invention to provide such an apparatus that will board socks with precision and consistency.

It is yet another object of the present invention to provide such a machine which will operate at a pace commensurate with the sock production machines and the sock processing machines.

To that end, an apparatus for boarding socks includes a skeletal frame formed from a plurality of subframes and defining a path of movement for one or more socks being boarded by the apparatus; an assembly for boarding one or more socks including a boarding subframe forming a portion of the skeletal frame; at least one sock form movably mounted to the boarding subframe, an assembly for moving the at least one sock form to a position along the path of movement for movement of the at least one sock form into one or more socks, thereby boarding the one or more socks; and an assembly for positioning a sock for engagement by the sock form, including a positioning subframe forming a portion of the skeletal frame, an assembly for supporting and moving a sock into a position for engagement by the sock form mounted to the positioning subframe, an assembly for opening one or more socks mounted to the positioning subframe for disposition of the one or more socks on the assembly for supporting and moving one or more socks into a position for engagement by the sock form, and an assembly for maintaining the one or more socks in an opened condition mounted to the positioning subframe for movement of the at least one sock form into a sock, thereby boarding the sock.

The present invention further includes an assembly for automatically controlling the operation of the apparatus operatively associated with the apparatus and including an arrangement for sensing a position of one or more socks along the path of movement and an arrangement for controlling the operation of the assembly for supporting and moving one or more socks into a position for engagement by the sock form, the assembly for opening one or more socks, the assembly for maintaining one or more socks in an opened condition, and the assembly for supporting and moving at least one sock form responsive to input from the arrangement for sensing a position of one or more socks along the path of movement indicating the position of one or more socks disposed along the path of movement thereby causing one or more socks introduced into the assembly for positioning one or more socks for engagement by the sock form be automatically boarded by the assembly for boarding one or more socks.

It is preferred that the present invention include an assembly for delivering one or more socks from a sock source to the assembly for positioning one or more socks for engagement by the at least one sock form including a delivery subframe forming a portion of the skeletal frame, and an assembly for moving one or more socks from the sock source into a position for engagement by the assembly for positioning one or more socks for engagement by the at least one sock form.

In one preferred embodiment, the assembly for moving one or more socks from the sock source into a position for engagement by the assembly for positioning one or more socks for engagement by the at least one sock form includes a driven, endless conveyor belt and the assembly for engaging one or more socks from the sock source is disposed at the beginning of the path of movement for depositing the one or socks thereby engaged onto the conveyor belt. The assembly for engaging one or more socks from the sock source is disposed at the beginning of the path of movement and for depositing the one or more socks thereby engaged onto the conveyor belt includes a conduit in communication with at least a portion of the conveyor belt and having a pressure therein that is less than atmospheric pressure for drawing one or more socks from an area of atmospheric pressure and depositing the one or more socks onto the conveyor belt.

In an alternate preferred embodiment, the assembly for moving one or more socks from the sock source into a position for engagement by the assembly for positioning one or more socks for engagement by at least one sock form includes a delivery tunnel or input tube slidably mounted on the upper portion of the delivery subframe for selective horizontal movement of the input tube between a start position and an extended, end position. The input tube of the second preferred embodiment has a generally rectangular shape substantially forming an enclosed tray for carrying one or more socks and includes an entrance end for receiving one or more socks and an exit end from which one or more socks are discharged from the input tube. The assembly includes a pressure-lowering device for creating pressure within the input tube less than atmospheric pressure for drawing one or more socks from an area of atmospheric pressure into the entrance end and through the input tube to the exit end of the input tube.

In the second preferred embodiment, the pressure-lowering device of the delivery assembly includes a vacuum tube positioned at the exit end of the input tube and in communication with a vacuum source for reducing the pressure within the input tube to rapidly draw one or more socks introduced into the entrance end through the tube to the exit end. The vacuum tube includes a vacuum mouth and is moveably mounted to the delivery subframe for vertical movement between a first, operational position at which the vacuum mouth is in alignment with the exit end and a second, non-operational position at which the vacuum tube is vertically lowered and the vacuum mouth is positioned below the exit end.

The delivery assembly of the second preferred embodiment also includes an assembly for engaging and retaining one or more socks disposed at the exit end of the input tube. The assembly includes a stop member for holding one or more socks at the exit end to prevent the one or more socks from being drawn into the vacuum tube. The stop member includes a plunger cylinder which has a vertically moveable plunger therein moveable between a retracted position and an extended down position to contact one or more socks as the one or more socks begin to exit the input tube at the exit end. In the extended position, the plunger pins the sock to the bottom of the tube thereby preventing the sock from being drawn into the vacuum tube. The plunger cylinder of the second preferred embodiment is slidably mounted for selective horizontal movement of the plunger cylinder between a first position near the exit end and a second position away from the exit end.

The delivery assembly of the second preferred embodiment further includes a pair of sensors disposed at the exit end of the input tube for sensing movement of one or more socks and actuating the necessary piston and cylinder arrangements to cause various movements. As in the first preferred embodiment, the sensors are preferably photocell sensors in communication with a microcomputer. A first sensor is mounted adjacent to and immediately prior to the exit end to sense the presence of one or more socks as the sock begins to proceed through the exit end of the input tube and produces a signal indicative of the presence of one or more socks along the path of movement and causes the microcomputer to activate the plunger cylinder to rapidly extend the plunger downward to its extended position into contact with one or more socks for pinning one or more socks to the bottom of the tube and retaining the sock therein. With the plunger in the extended position, the plunger cylinder moves horizontally away from the exit end so that the one or more socks are pulled back into the input tube. At the same time, the first sensor of the second preferred embodiment causes the vacuum source to be shut off and the vacuum tube is lowered from the first, operational position to the second, non-operational position.

In the second preferred embodiment, a second sensor is mounted on the subframe to project outward therefrom so that it is positioned immediately after the exit end to sense the presence of one or more socks being pulled back into the inlet tube for producing a signal indicative of the absence of one or more socks as they are pulled into the input tube so that the end or absence of the sock at the exit end is detected by the second sensor and causes the microcomputer to move the input tube forward to deliver the sock from the exit end of the input tube.

The present invention further includes a pair of driven rolls forming a nip mounted to the skeletal frame along the path of movement for engagement of one or more socks to eject the one or more socks from the assembly for delivering one or more socks from the sock source in a manner for acquisition by the assembly for positioning one or more socks for engagement by the at least one sock form. The rolls preferably each include a textured surface for releasable adherence thereto of one or more socks passing through the nip to thereby open the one or more socks releasably adhered thereto.

The positioning subframe forming the portion of the skeletal frame is disposed closely adjacent the delivery subframe of receiving one or more socks from the assembly for delivering one or more socks from the sock source to the assembly for positioning one or more socks for engagement by the at least one sock form. Preferably, the boarding subframe includes a plurality of vertically extending support members and a plurality of horizontally extending support members attached thereto with at least a portion of the support members defining a support surface, and the assembly for boarding one or more socks includes at least one sock form movably mounted the boarding subframe with at least one slider mounted to the at least one sock form for control slotting movement of the at least one sock form along the support surface. In an alternate preferred embodiment, the boarding assembly includes a plurality of boarding subframes rotatably mounted therein for selectively rotating one subframe after another into position for boarding one or more socks onto at least one sock form mounted on the subframe.

It is preferred that the assembly for moving the at least one sock form to a position along the path of movement for movement of the at least one sock form into one or more socks includes a piston and cylinder arrangement mounted to a vertically extending support member and having a selectively movable rod emitting from the cylinder and attached to the at least one sock form for controlled vertical movement of the at least one sock form. The apparatus according to the present invention further includes at least one wheel mounted to the selectively movable rod in contact with the support surface for rolling contact therewith for stabilizing the at least one sock form during vertical movement thereof. Preferably, the assembly for moving the at least one sock form to a position along the path of movement for movement of the at least one sock form into one or more socks further includes a piston a cylinder arrangement mounted to a horizontally extending support member and having a selectively movable rod emitting from the cylinder and attached to the at least one slider for controlled horizontal movement of the at least one slider thereby moving the at least one sock form. Preferably, the at least one sock form is disposed on the boarding subframe for driven movement to a predetermined closed path by the piston and cylinder arrangements. The assembly for supporting and moving one or more socks into a position for engagement by the at least one sock form preferably includes a sock carrier movably mounted to the positioning subframe for movement between a first position for receiving one or more socks and a second position for engagement of the one or more socks by the at least one sock form. Preferably, the sock carrier is formed from at least two parallelly extending rectangular support members, each being formed with at least one air passage therethrough and the assembly for maintaining one or more socks in an opened condition includes an assembly for injecting air into the passages for inflation of one or more socks supported by the carrier to enhance the ability of the one or more socks to accept the at least one sock form.

It is preferred that the assembly for positioning one or more socks for engagement by the at least one sock form includes a pair of driven rolls movably mounted to the positioning subframe for movement between a first position wherein the rolls are separated by the sock carrier and a second position wherein the rolls are in contact with one or more socks disposed on the carrier for rotational movement of the one or socks disposed on the carrier responsive to rotational movement of the rolls. Preferably, each of the rolls includes a textured contact surface for engagement with the one or more socks to enhance the ability of the rolls to impart motion to the one or more socks disposed on the carrier.

The first preferred embodiment of the present invention further includes a platform support frame formed as a portion of the positioning subframe and a platform mounted to the platform subframe for disposition of the platform under the carrier when the carrier is at its second position and the arrangement sensing a position of one or more socks along the path of movement includes a photocell mounted to the platform to sense the position of one or more socks thereat as being acceptable for entry of the at least one sock form, the photocell emitting a signal to the assembly for automatically controlling the operation of the apparatus to cause rotation of the rolls to cease thereby halting rotational movement of the one or more socks disposed on the carrier. Alternately, the second preferred embodiment provides a flow of air to contact the one or more socks disposed on the carrier and urge the one or more socks toward a photocell mounted to the subframe to sense the position of one or more socks thereat as being acceptable for entry of the at least one sock form, the photocell emitting a signal to the assembly for automatically controlling the operation of the apparatus to cause rotation of the rolls to cease thereby halting rotational movement of the one or more socks disposed on the carrier.

Preferably, the assembly for opening one or more socks includes an opening unit slidably mounted to the positioning subframe and having a plurality of outwardly projecting arms for disposal of one or more socks thereon, the arms being movable between a first position wherein the arms are closely adjacent one another and a second position wherein the arms are mutually displaced by a predetermined distance, thereby opening any sock or socks disposed thereon, the opening unit being movable between the first position for receiving one or more socks onto the arms and a second position for deposit of the one or more socks on to the assembly for positioning one or more socks for engagement by the at least one sock form. Preferably, the opening unit includes four outwardly projecting arms arranged in two pairs and includes an arrangement to operatively engage one member of each pair with the other member of that pair including at least one gear mounted to each arm in meshed engagement with one another to cause induced movement of one arm to cause movement of the other paired arm, with all arms being arranged for movement away from one another once one or more socks are disposed thereon.

It is preferred that the assembly for automatically controlling operation of the apparatus include a preprogrammed microcomputer. It is further preferred that the arrangement for sensing a position of one or more socks along the path of movement includes a plurality of photocells for production of signals indicative of the presence of one or more socks along the path of movement with the photocells being mounted to the skeletal frame at predetermined locations along the path of movement and operatively connected to the microcomputer for processing of signals produced by the photocells thereby. It is preferred that the arrangement for controlling the operation of the assembly for supporting and moving one or more socks into a position for engagement by the at least one sock form, the assembly for opening one or more socks, the assembly for maintaining one or more socks in an open condition, and the assembly for moving the at least one sock form includes an assembly for responding to the position of one or more socks disposed along the path of movement and operating the assembly for supporting and moving one or more socks into a position for engagement by the at least one sock form, the assembly for opening one or more socks, the assembly for maintaining one or more socks in an opened condition, and the assembly for moving the at least one sock form thereby causing one or more socks introduced into the assembly for positioning one or more socks for engagement by the at least one sock form to be automatically boarded by the assembly for boarding one or more socks.

By the above, the present invention provides an automatic apparatus for receiving one or more socks and accurately and quickly boarding the one or more socks for further processing.

BRIEF DESCRIPTION OF THE DRAWINGS

FIG. 1*b* is a side view of the apparatus illustrated in FIG. 1*a* with the sock having advanced to the conveyor belt;

FIG. 1*l* is a side view of the apparatus with the sock board being withdrawn from the boarding area;

FIG. 5*b* is a perspective view of a sock being advanced over the arms of the opening unit;

DESCRIPTION OF THE PREFERRED EMBODIMENT

Figure 1:
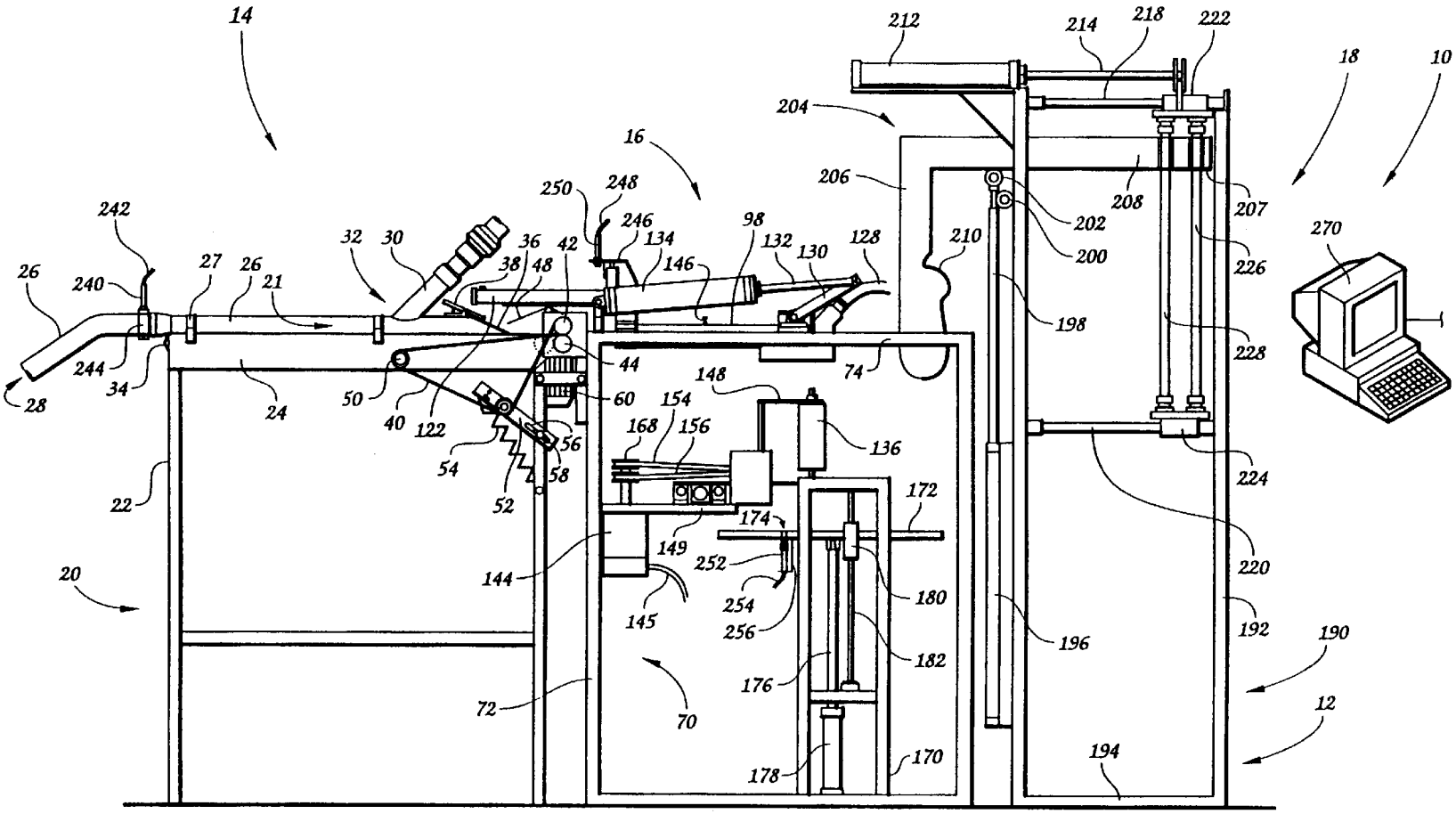
FIG. 1 is a side view of the apparatus for automatically boarding one or more socks according to the first preferred embodiment of the present invention.

Turning now to the drawings and, more particularly to FIG. 1, an apparatus for automatically boarding socks is illustrated generally at 10 and includes three major subsystems, or assemblies, including the delivery assembly 14, the positioning assembly 16, and the boarding assembly 18. Each subsystem is defined primarily by a separate subframe. These include the delivery subframe 14, also illustrated in FIG. 2, the positioning subframe 16, also illustrated in FIG. 3; and the boarding subframe 18, also illustrated in FIG. 4. Together, the subframes 14, 16, 18 make a complete skeletal framework 12.

The skeletal framework 12 is formed from a plurality of vertical and horizontally extending support members, which may be steel, aluminum, or other suitable material, and are fixed together in a predetermined arrangement. Collectively, all of the subframes 14, 16, 18 combine to define a path of movement 21 for one or more socks through the apparatus 10. As illustrated throughout the drawings, it is preferred that the socks be boarded singly, but it is anticipated that the present invention is adaptable for boarding multiple socks either singly on multiple boards in nested pairs on multiple boards, or in nested pairs on an individual board. It will therefore be appreciated by the those skilled in the art that the principles involved with the present invention are susceptible to a wide range of adaptation to fit many different circumstances requiring automatic sock boarding. It will additionally be appreciated by those skilled in the art that the term "boarding" is used to describe the placement of one or more socks onto a sock form, i.e., a foot-shaped form which, from the side, has the general outline of a foot while being generally flat and planar otherwise. Once boarded, manufactured socks may then be further processed before ultimate shipment. The processing typically takes place on the board and may include clipping of loose yarn strands, pressing or ironing, and imprinting. It is beyond the scope of the present invention to describe every operation which may be performed on a pair of socks during manufacture. Nevertheless, it is the focus of the present application to describe and illustrate a component of the sock manufacturing process heretofore unknown, i.e., an automatic sock boarding apparatus.

As will be seen in greater detail hereinafter, the first preferred embodiment of the present invention includes several motors, piston/cylinder arrangements, and an air system, all of which are controlled by a microcomputer 270, illustrated generally in FIG. 1. It will be appreciated by those skilled in the art that the microcomputer 270 operates based on commercially available control software with inputs from the various sensors and outputs to the various motors, air system, and piston/cylinder arrangements as will be seen in greater detail hereinafter.

The three primary subsystems are all interrelated and perform various functions on socks. The boarding assembly 18 acts to move the sock board into mating engagement with a sock held by the positioning assembly. The positioning assembly acts to receive a sock from the delivery assembly and position the sock for engagement by the sock board. The delivery assembly 14 receives the sock from whatever sock forming operation occurs prior to intervention by the present invention and delivers the sock to the positioning assembly 16 in a manner conforming to requirements imposed by the positioning assembly 16.

Figure 2:
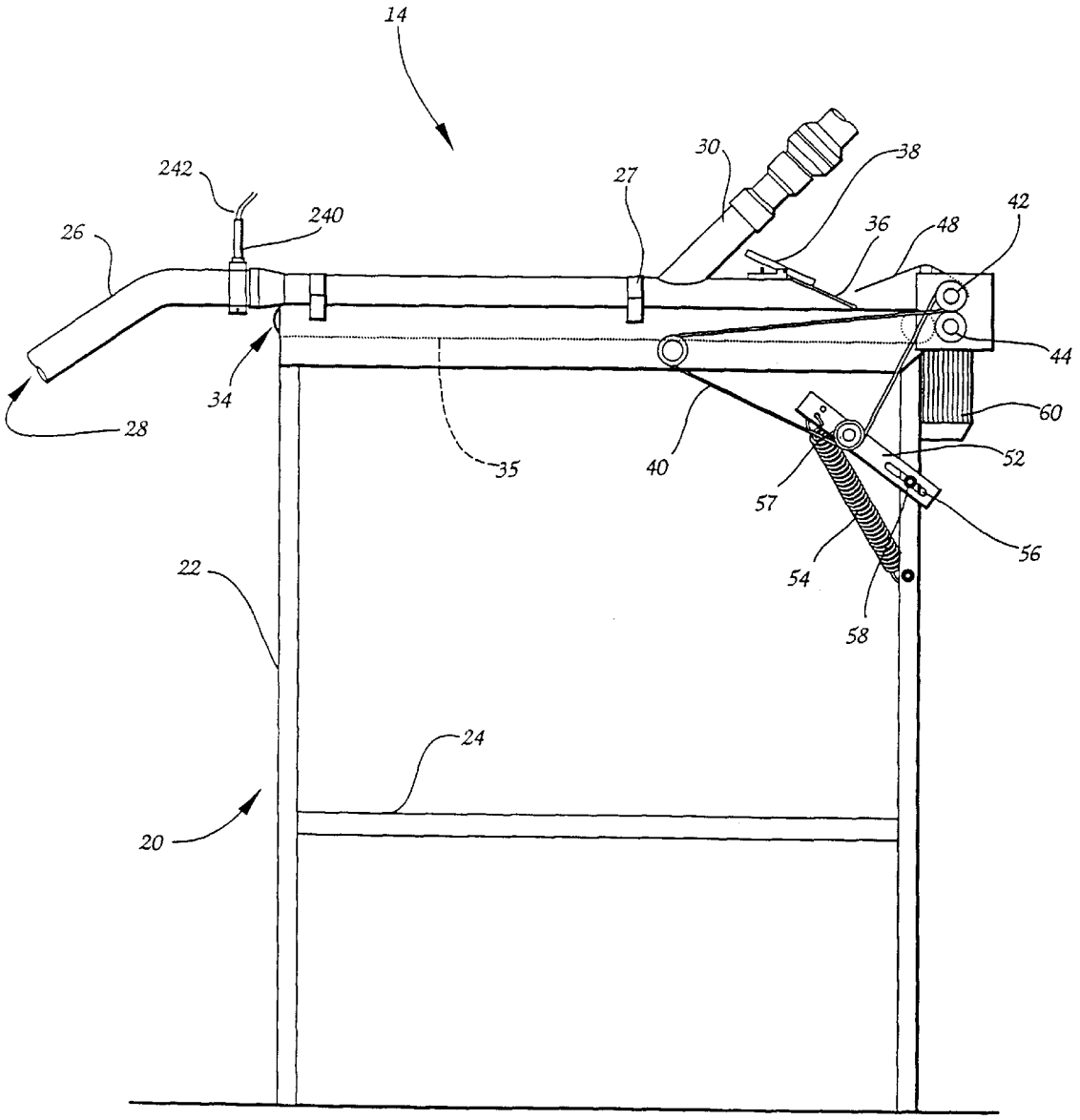
FIG. 2 is a side view of the delivery assembly according to the first preferred embodiment of the present invention.
Figure 5:
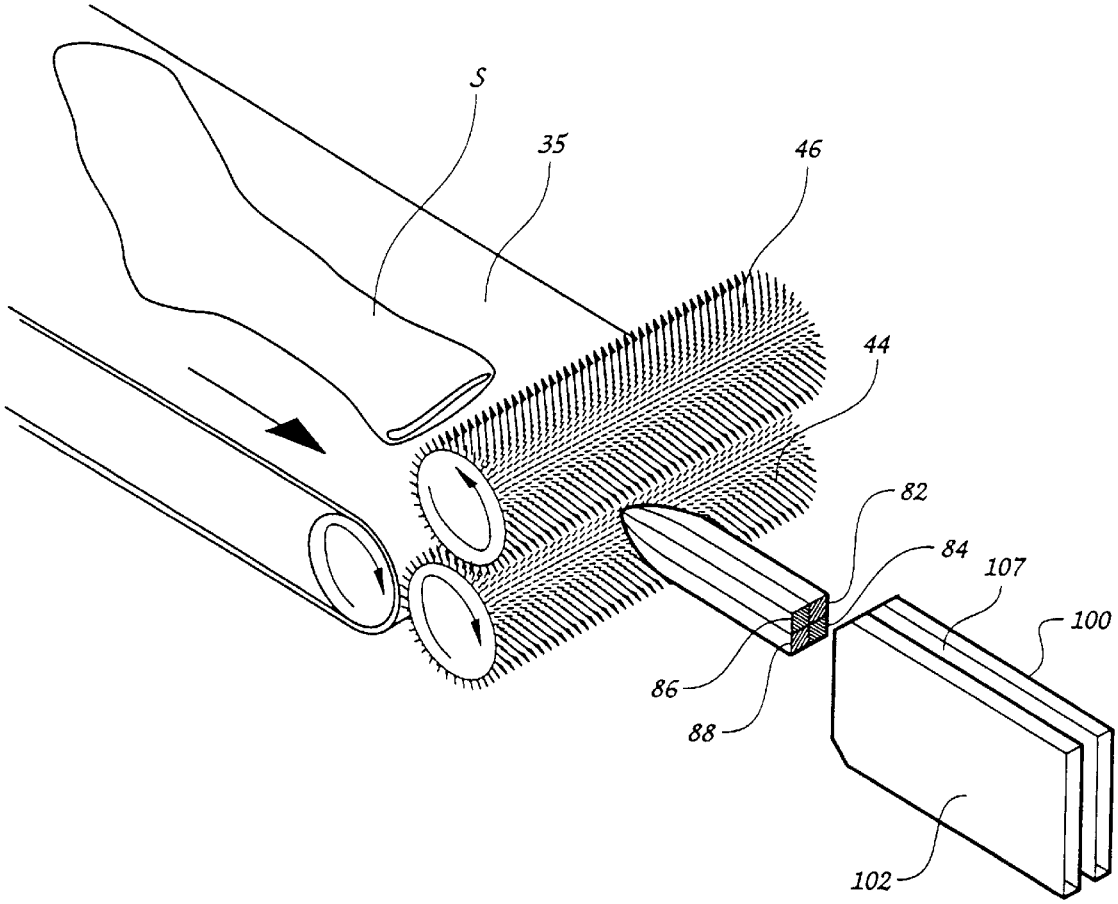
FIG. 5 is a perspective view of a sock approaching the delivery nip rolls on the conveyor belt.

Turning to FIGS. 1 and 2, the delivery assembly 14 of the first preferred embodiment will be described in greater detail. As is now known, the delivery assembly 14 accepts one or more socks from a sock source (not shown) which may be a knitter or other sock production apparatus and delivers the one or more socks to the positioning assembly 16 in the correct orientation for further use by the positioning assembly 16. The delivery assembly 14 includes a delivery subframe 20 including a plurality of vertical support members 22 and horizontal support members 24 which are arranged in a skeletal fashion to support the various parts which comprise the delivery assembly 14. A transparent delivery tunnel 26 is provided and mounted to the upper portion of the delivery subframe 20 and is held thereonto by clamps 27. The delivery tunnel 26 includes a generally tubular entrance portion 28 which receives the sock from the knitter or other apparatus in a manner which will be described in greater detail hereinafter and deposits the sock within the semicircular main body portion of the delivery tunnel 26. A conveyor belt 34 is formed as a conventional, endless belt and is disposed directly underneath the semicircular portion of the delivery tunnel 26. A vacuum tube 30 is attached to the delivery tube 26 and is in fluid communication with a vacuum source (not shown) which will create a vacuum within the delivery tunnel 26. A vacuum integrity door 36 is disposed at an end of the delivery tube 26 opposite from the entrance end 28. A stop member 48 is formed as a generally flat plate mounted over the door 36 to prevent excessive vacuum loss by abbreviating the path of movement undergone by the door 36. The door 36 includes an operating handle 38 and will operate when bumped from inside by a sock on the conveyor belt 34. The door 36 acts to maintain the vacuum while allowing the sock to exit the vacuum area on its way out of the delivery assembly 14. A pair of nip rolls 42, 44 are disposed at the delivery end of the conveyor 34 for engagement of the sock moving along the conveyor 34 in order to open the sock for acceptance by the opening unit, as will be described in greater detail hereinafter. As seen in FIG. 5, the nip rolls 42, 44 include a texturized surface 46 for engagement with the loosely knit sock fabric. As seen in FIGS. 5, 5*a*, 5*b*, and 5*c*, the textured surface 46 acts to open any sock S passing therethrough such that the open portion may be engaged by arms 82, 84, 86, 88 associated with the opening unit.

In the first preferred embodiment, the nips rolls 42, 44 are driven by a belt 40 which is also configured to drive the conveyor belt 34. An electric motor 60 is provided for the driving motive force. Tension is maintained on the belt using a conventional spring-type tension system. A bracket 52 is provided and mounted to the subframe 20 and includes a slot 56 mounted with a pivot pin 58 therethrough. Therefore, the mounting bracket may float and move under the influence of a biasing spring 54 which is provided to bias the bracket downwardly thereby bringing an idler roller 57 into contact with the belt 40 thus providing tension. The spring 54 is fixed to a vertical frame member 22 and the bracket 56.

As will be discussed in greater hereinafter, a photoelectric sensor 240 is provided and mounted to the delivery tunnel 26 immediately prior to the conveyor 34 to sense the presence of the sock which is about to enter the system on the conveyor 34. Wiring 242 provides a route for the electrical signal from the photocell to the microcomputer 270.

In the above-described manner, the delivery system receives a sock or socks from a knitter or other apparatus and delivers them to the sock positioning assembly 16 in a useful manner.

Figure 3:
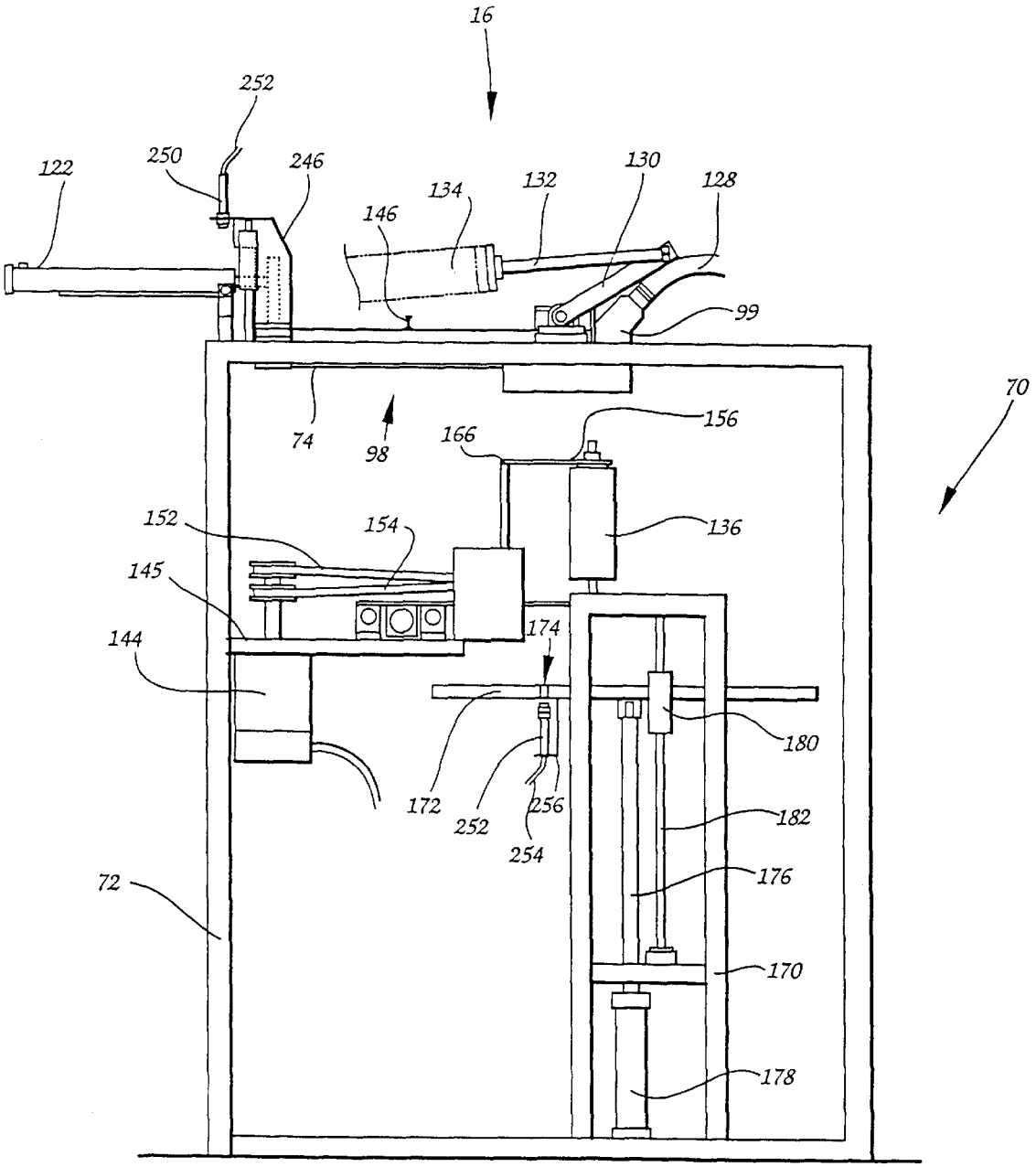
FIG. 3 is a side view of the sock positioning assembly according to the first preferred embodiment of the present invention.
Figure 4:
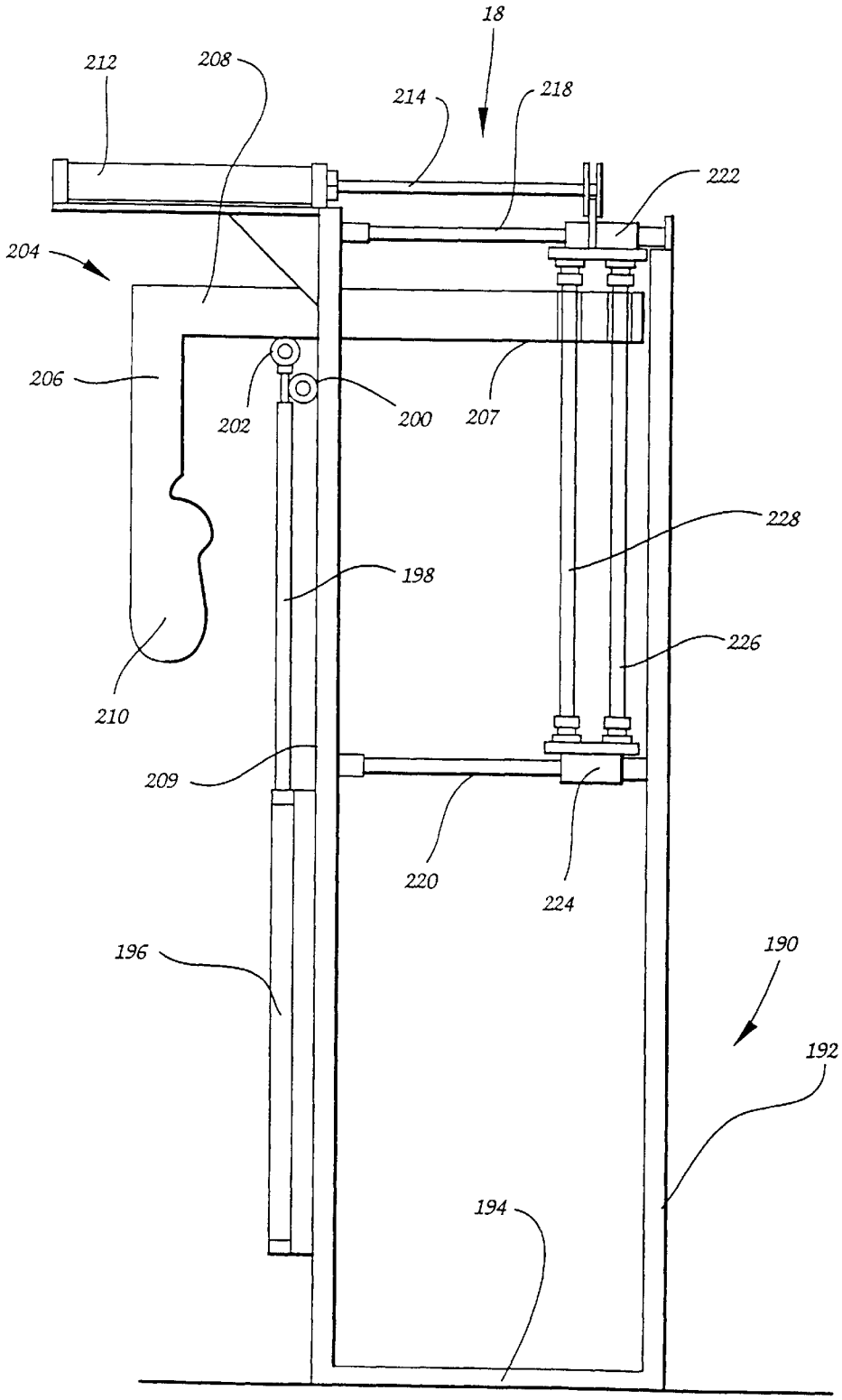
FIG. 4 is a side view of the boarding assembly according to the first preferred embodiment of the present invention.

Turning to FIGS. 1 and 3, the positioning assembly 16 of the first preferred embodiment is illustrated. The positioning assembly 16 receives one or more socks from the delivery subsystem 14 and positions the sock for insertion of a sock form, or board, therein.

Turning now to FIG. 3, the sock positioning assembly is illustrated generally at 16 and is provided for receiving one or more socks from the delivery assembly 14, positioning and holding sock for insertion of the sock form during boarding.

Like the remainder of the skeletal frame structure 12, the positioning assembly 16 includes a positioning subframe 70 formed from vertically extending support members 72 and horizontally extending support members 74. Perhaps the most complex subsystem of the apparatus 10, the positioning assembly 16 includes mechanical devices to receive the sock from the delivery system, open the sock, place the sock on the sock carrier, the position the sock for insertion of the sock board.

Figure 8:
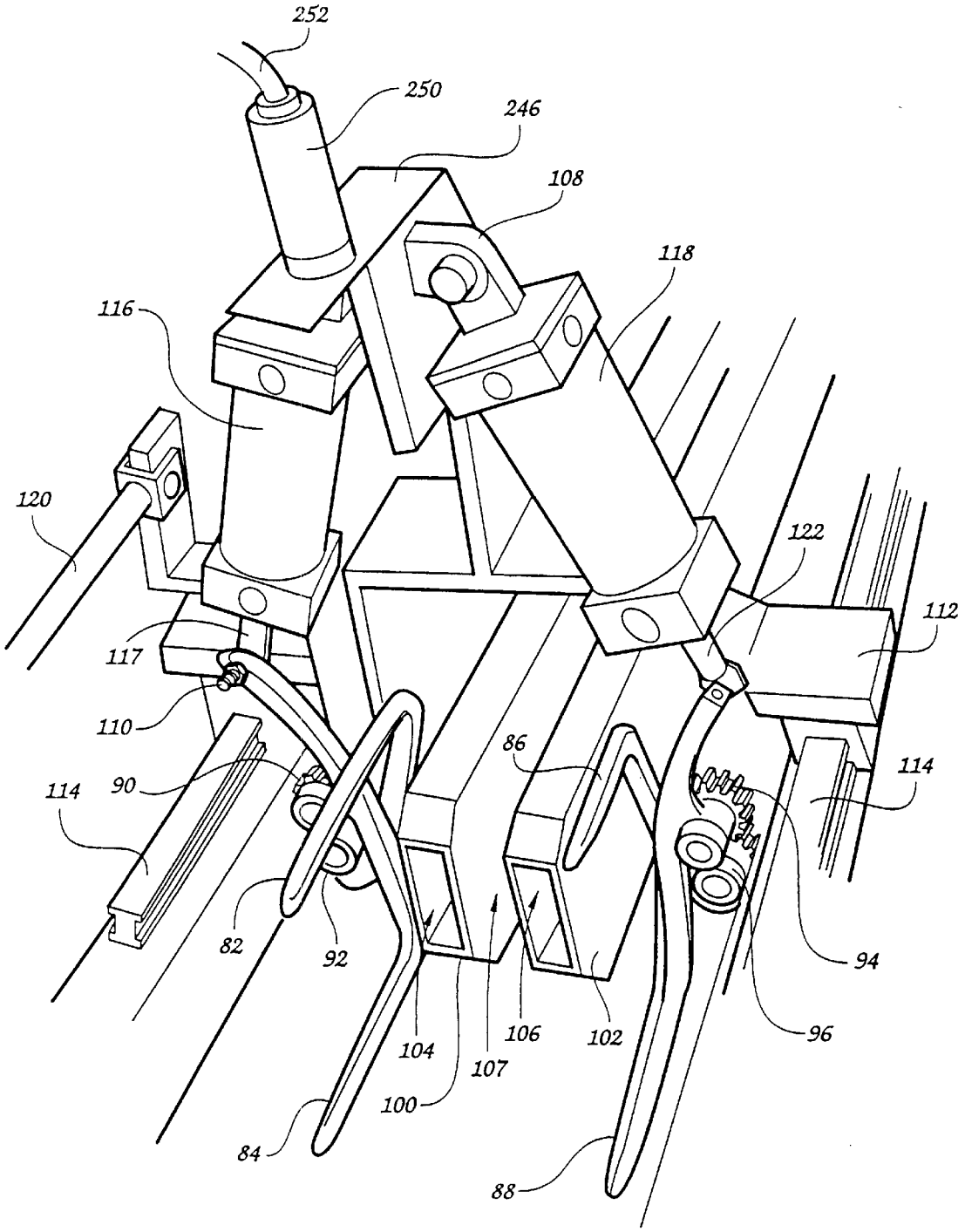
FIG. 8 is a perspective view of the opening unit and its positioning relative to the sock carrier.

To that end, and with reference to FIG. 8, an opening unit 80 is provided. The opening unit consists of four horizontally extending arms 82, 84, 86, 88 which are paired. Each arm 82, 84, 86, 88 consists of a generally L-shaped member having a gear 90, 92, 94, 96 attached thereto. The arms are configured for movement in a scissor-like fashion with driving movement of one arm inducing driving movement of its paired arm through the respective gears. The arms are configured for horizontal extension in a mutually abutting relationship prior to opening and, as will be seen, when the sock is fitted thereunto, the arms are moved and they spread away from each other.

As seen in FIG. 8, each pair of arms is driven by a piston/cylinder arrangement 116, 118 with arms 117, 122 extending therefrom and are pivotally attached to each sock spreading arm 82, 84, 86, 88 using conventional nuts and bolts 110. Movement of the arms 82, 84, 86, 88 of the opening unit is controlled by the microcomputer 270 which receives input from a photocell sensor 250 which is mounted to the opening unit 80 using a bracket 246. When the sock is driven onto the opening unit 80, the sensor 250 senses its position, thereby initiating operation of the opening unit 80. The opening unit 80 is formed with a slider 112 mounted to rails 114 such that it may move horizontally, back and forth along the rails 114, under controlled influence. A piston/cylinder arrangement 122 is mounted to the positioning subframe 70 and includes an operating arm 120 projecting outwardly therefrom. The operating arm 120 is mounted to the opening unit 80 for controlled sliding movement of the opening unit 80 along the rails 114.

As previously stated, the opening unit 80 acts to open the sock and position it on a sock carrier. The sock carrier includes two generally rectangular elongate members arranged in a parallel, side-by-side relationship. The elongate members 100, 102 include air channels 104, 106 formed therein. Further, and with reference to FIG. 3, the carrier members 100, 102 extend outwardly from an air plenum 99 which receives air from an air supply (not shown) through a hose 128 projecting outwardly therefrom. The entire carrier unit 98 is pivotally mounted to the positioning subframe 70 adjacent a top portion thereof for rotating movement between a generally horizontally extending position for accepting socks from the opening unit 80 and a generally vertically downwardly extending position which positions the sock for receipt of the sock board. A stop member 46 projects outwardly from each carrier member 100, 102 to doff the sock from the opening unit 80 onto the carrier 98. A spacing 107 exists between the two carrier members 100, 102 with the spacing 107 being wide enough so that the sock board may fit therebetween. A piston/ cylinder arrangement 134 is mounted to the positioning subframe 70 as seen in FIG. 1. An operating rod 132 projects outwardly from the piston/cylinder 134 and is connected to the carrier 98 by a mechanical link 130 such that inward movement of the operating rod 132 causes pivoting movement of the carrier 98. As may be expected, operation of the piston/cylinder 134 to control the carrier 98 is controlled by the microcomputer 270.

Once the carrier has been moved to the vertical position, the air system is used to inflate the sock for ease of acceptance of the sock board. Nevertheless, once the sock is inflated, it must be positioned with the toe portion correctly aligned to receive the sock board. Once the carrier has been moved from its horizontal orientation to a vertical orientation, two more operations must be performed on the sock before it is ready to accept the sock board. Initially, the sock is inflated using air supplied from the air source (not shown) through the air channels 104, 106 within the carrier 98. Secondly, the sock must be rotated into a position where the toe and heel are properly oriented for receipt of the vertically descending sock board.

Figure 6:
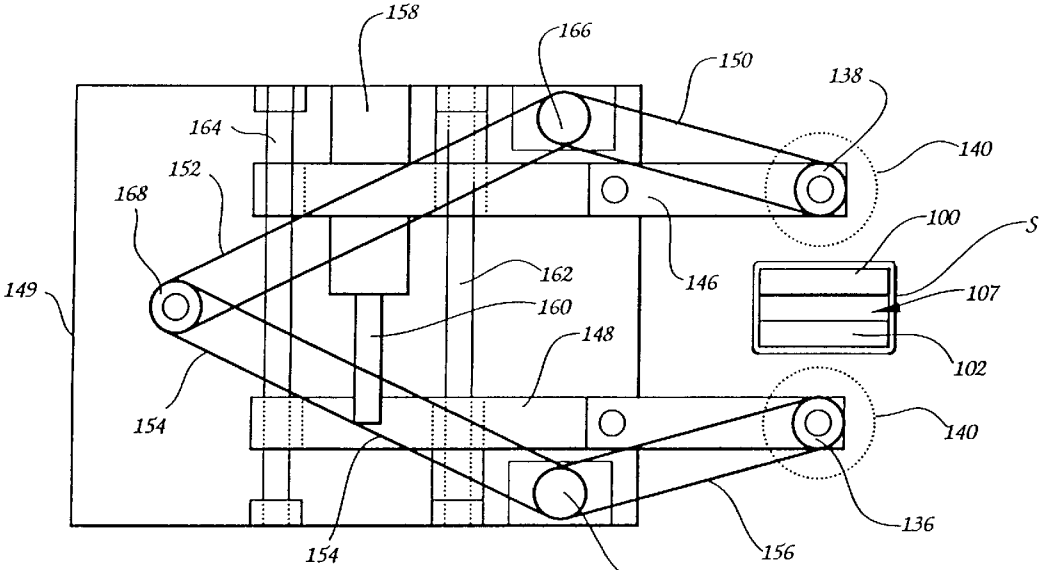
FIG. 6 is a top plan view of a portion of the sock positioning assembly with the sock rotating rolls out of contact with a sock on the carrier.
Figure 6A:
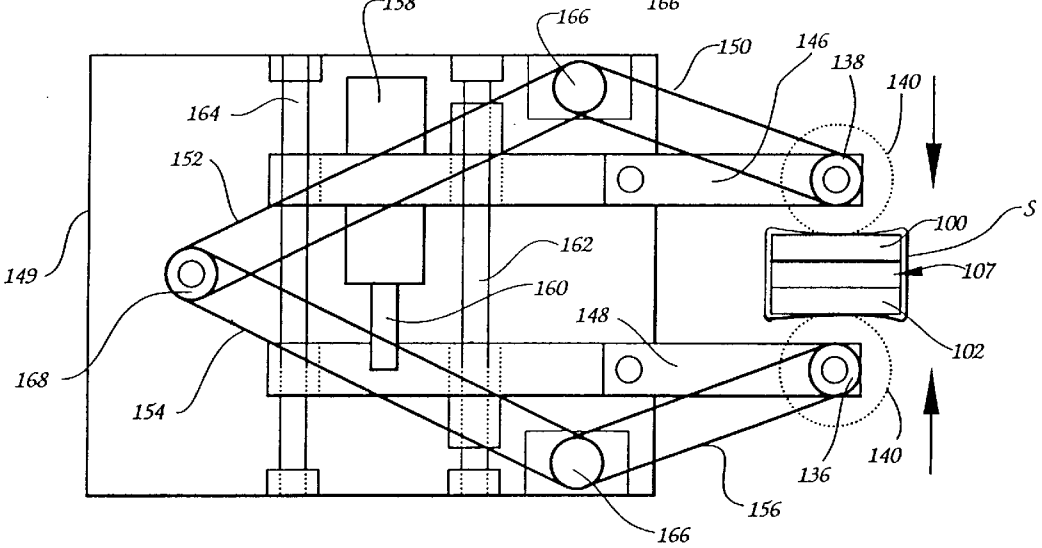
FIG. 6*a* is a top plan view of the apparatus illustrated in FIG. 6 with the sock rotating rolls in contact with a sock on the carrier.
Figure 7:
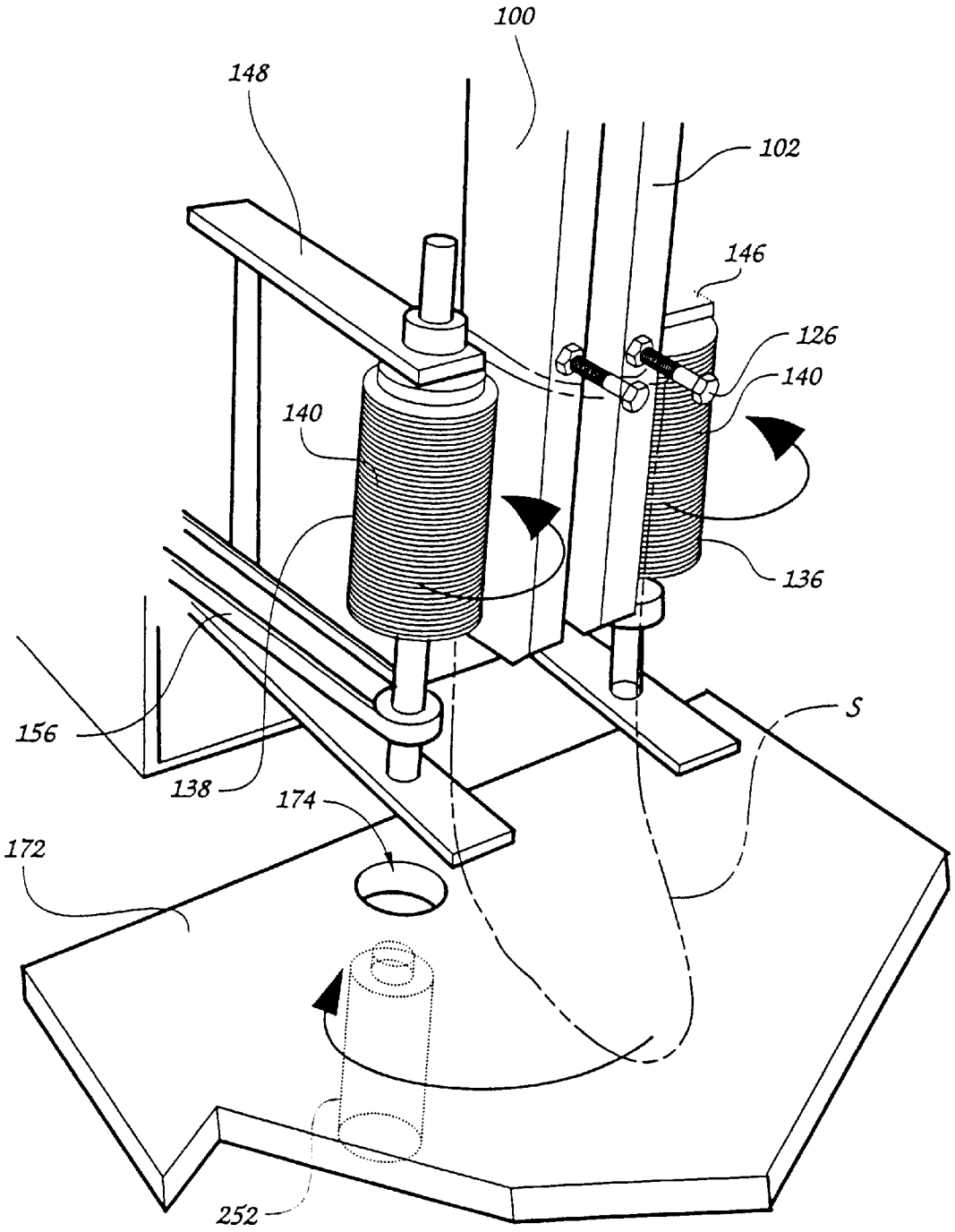
FIG. 7 is a perspective view of the rolls illustrated in FIG. 6 rotating a sock on the carrier.
Figure 7A:
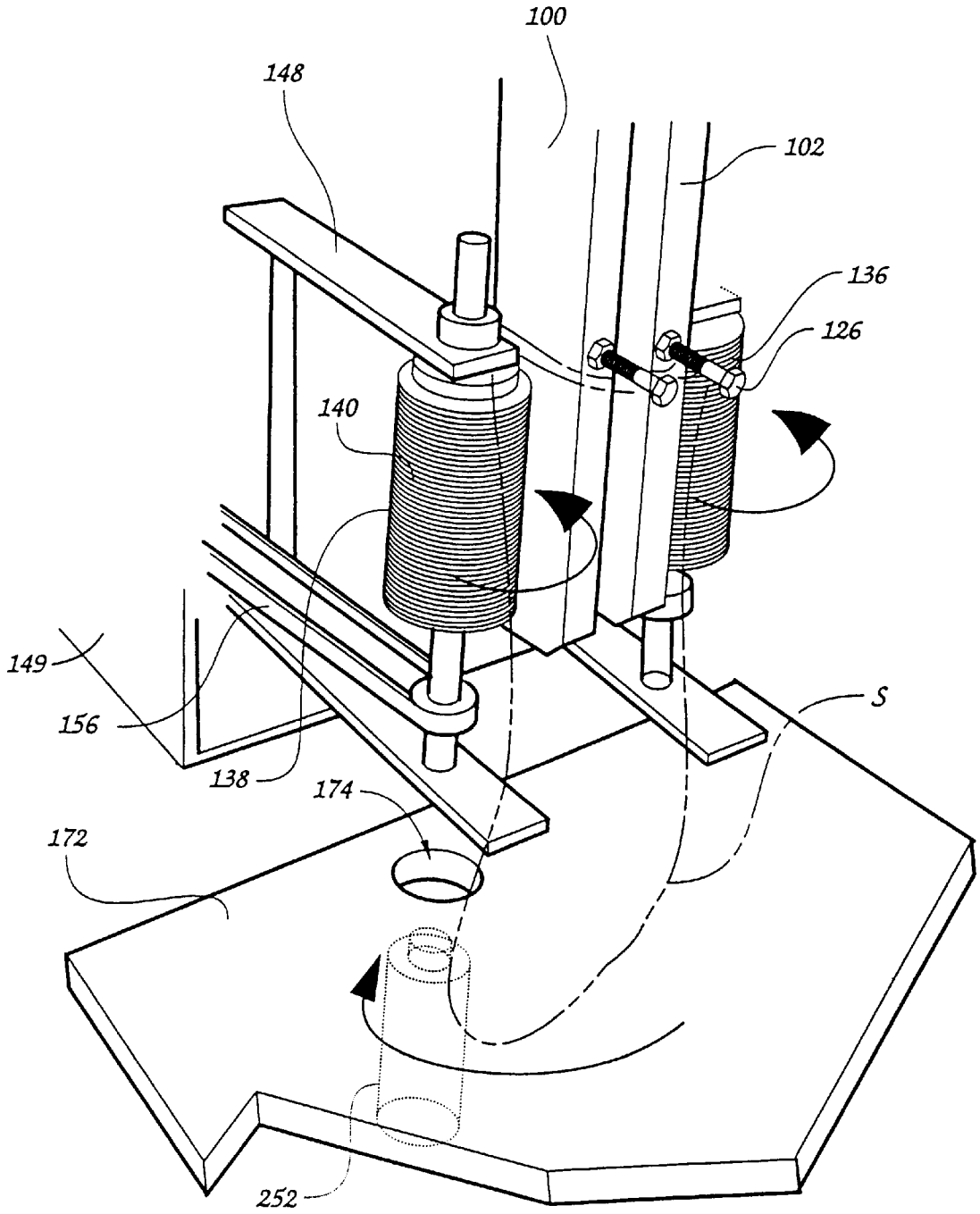
FIG. 7*a* is a perspective view of the apparatus illustrated in FIG. 7 with the sock continuing rotation.
Figure 7B:
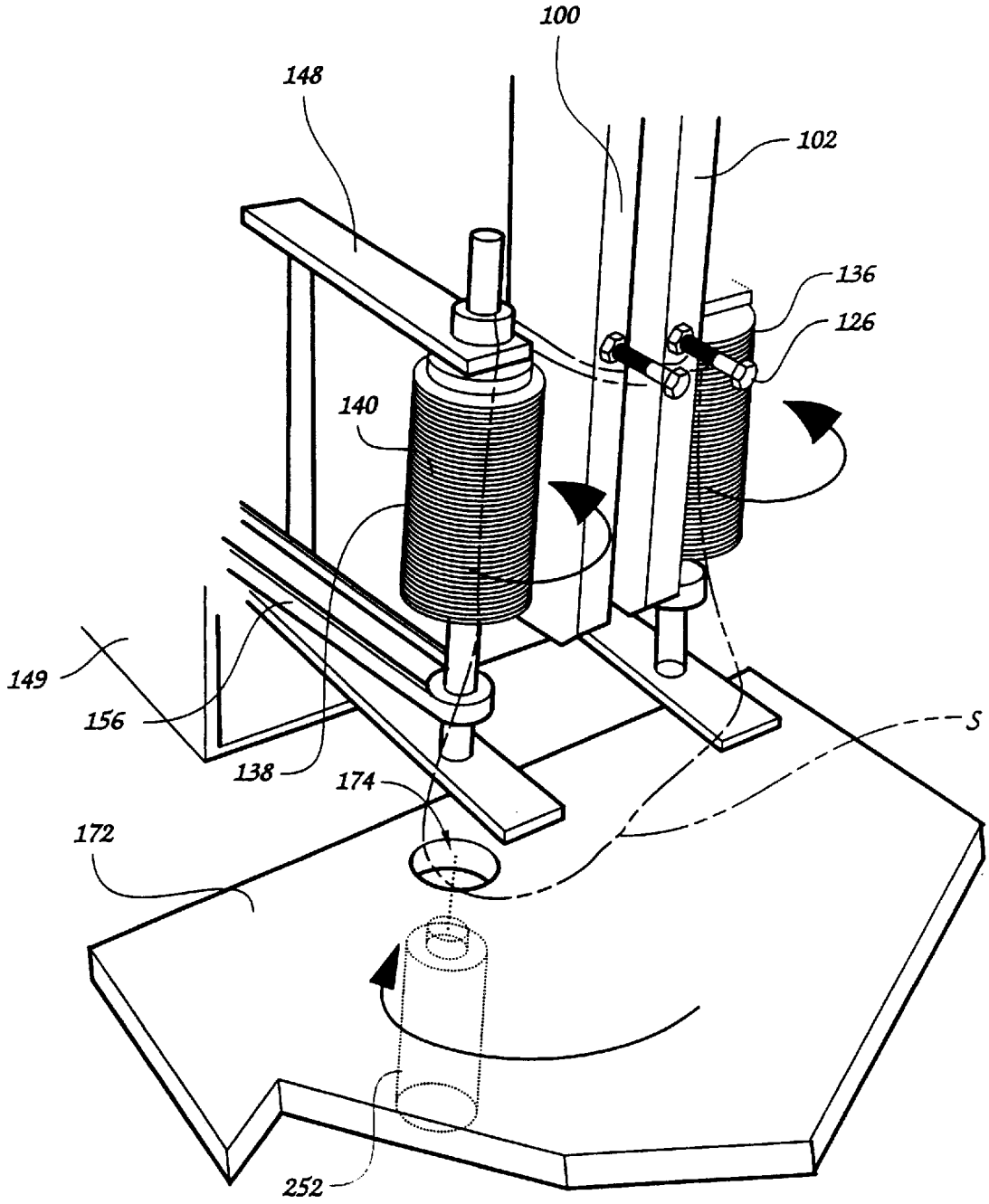
FIG. 7*b* is a perspective view of the apparatus illustrated in FIG. 7*a* with the sock rotated into position for boarding.

Referring now to FIGS. 3, 6, and 6*a*, the sock rotating system is illustrated and includes a mounting platform 145 projecting inwardly into the skeletal positioning subframe 16 at a position vertically disposed underneath the carrier 98. An electric motor 144 is mounted to the support member 145 and is configured for driving two horizontally oriented belts 152, 154. As best seen in FIGS. 6 and 6*a*, the two belts 152, 154 are connected using idler wheels 166 to two more belts 150, 156 which are configured to rotate two spaced positioning rolls 136, 138. The positioning rolls 136, 138 each include a textured surface 140 for contact with a sock mounted on the carrier 98. The positioning rolls 136, 138 are caused to rotate in the same direction so as to effect rotation of sock S disposed on the carrier 98 upon contact therewith. This relationship is best seen in FIGS. 7, 7*a*, and 7*b*. Since the carrier 98 must be moved into a vertical position intermediate the rolls 136, 138, the rolls must be spaced sufficiently from one another to allow the carrier 98 to swing into position intermediate the rolls 136, 138 and then be moved into a contact position with a sock disposed on the carrier. This operation is best seen in FIGS. 6 and 6*a*.

With continued reference to FIGS. 6 and 6*a*, the positioning rolls 136, 138 are rotatably mounted to elongate support members 146, 148 which are slidably mounted to a pair of parallelly extending slider rods 162, 164 which are in turn mounted to the overall support member 145. A piston cylinder arrangement 158 is provided with a control rod 160 attached to one of the roller support members 148. The cylinder 158 is attached to the other of the support members 146. Therefore, withdrawing working fluid from the cylinder acts to draw the rod into the cylinder and, due to the mounting arrangement, acts to draw the roll support members 146, 148 toward one another. As illustrated in FIGS. 6 and 6*a*, this action causes the positioning rolls 136, 138 to be drawn toward one another and toward the sock which is by then positioned intermediate the rolls 136, 138. As will be seen in greater detail hereinafter, once the sock is rotated into the proper position for boarding, the positioning rolls are caused to move in the opposite direction, i.e., away from one another, and away from the sock disposed on the carrier 98.

As previously stated, the sock is inflated and causes to rotate until the toe is in a predetermined position for receipt of the sock board therein. In the first preferred embodiment, the position of the sock is sensed by a photocell 252 mounted to a platform 172 with a sight aperture 174 formed therein. As seen in FIGS. 7, 7*a*, and 7*b*, the sock rotates across the platform 172 until it is positioned over the photocell 252 as sensed through the aperture 174. Once the sock is in position, the photocell signals the microcomputer 270 which initiates an operation to separate the positioning rolls 136, 138 from the sock S disposed on the carrier 98. The photocell 252 is mounted to the underside of the platform 172 using a conventional metal bracket 256 and is in communication with the microcomputer 270 with conventional wiring 254 projecting from the photocell 252. The platform 172 is mounted to a platform subframe 170 which is another skeletal frame formed from vertical and horizontal support members and positioned underneath the carrier 98. The platform 172 is mounted to the apparatus 10 using a piston and cylinder arrangement 178 and a support/control rod 176 projecting vertically upwardly from the piston/cylinder arrangement 178. For stabilization, a vertical stabilization member 182 is formed as a generally cylindrical rod and includes a slider 180 mounted to the stabilization member 182 as well as the table 172. In this manner, the platform 172 may be raised and lowered by the piston cylinder arrangement 178 and stabilized by its relationship with the slider 180 along the stabilization member 182. As will be seen, as the sock board descends into the sock, the platform 172 drops away from the sock allowing full movement of the sock board. One function of the table, other than supporting the photocell 252, is manifest when a loosely knit sock transits the apparatus 10. Since such a loosely knit sock may not remain inflated even under the influence of constantly applied inflating air, the platform acts as a support to support the toe of the sock as it is being rotated by the positioning rolls 136, 138 so that the photocell 252 will recognize such a semi-inflated sock as being in proper position for boarding.

The apparatus described thus far has been described to receive a sock from a sock-forming machine and position the sock for receipt by the sock positioning system. The sock positioning system has then been described as positioning the sock for receipt of a sock board. The final subsystem is the boarding subsystem 18 of the first preferred embodiment illustrated in FIGS. 1 and 4. The boarding subsystem 18 includes a boarding subframe 190 which is formed from vertically extending support members 192 in conjunction with horizontally extending support members 194. A primary feature of the boarding subsystem 18 is the sock board 204. The sock board 204 is generally L-shaped and includes a horizontally extending support member 208 and a vertically extending board member 206 projecting perpendicularly downwardly from the horizontally extending support member 208. A generally sock-shaped end portion 210 is formed at the distal end of the vertically extending member board 206. The sock board 204 is mounted to the subframe 190 in a configuration which will allow the sock board to trace a square or rectangular path during boarding operations.

To that end, it will be appreciated that the sock board 204 must be capable of independent vertical and horizontal movement. Therefore, to effect horizontal movement, two horizontal, vertically-spaced slider rods 218, 220 are provided and mounted to the subframe 18 and extend between two vertically extending frame members 192. A pair of sliders 222, 224 are slidably mounted to the slider rods 218, 220 for sliding movement back and forth along the rods. The upper slider 222 is operationally connected to a piston/cylinder arrangement 212 which includes a control rod 214 projecting outwardly therefrom and connected to the upper slider 222. Therefore, actuation of the horizontal piston/ cylinder arrangement 212 will cause the sock board 204 to move backward and forward in a horizontal plane.

A vertically-oriented piston/cylinder arrangement 196 is mounted to one of the vertically extending support members 192 and includes a control rod 198 projecting outwardly therefrom. The outwardly extent of the control rod 198 includes a wheel 202 mounted thereto, with the wheel 202 being in contact with a rolling surface 207 formed on the underside of the horizontally extending member 208 associated with the sock board 204. Accordingly, the sock form 204 is allowed to move horizontally with the wheel 202 reducing any frictional contact which may be present. A second wheel 200 is mounted to the control rod 198 and is contact with a rolling surface 209 associated with the vertical support member 192 closely adjacent the control rod 198. This provides a support for vertical movement of the control rod 198 and, consequently, the sock board 204. Openings are formed in the horizontally extending portion 208 of the sock board 204 through which vertical slider rods 226, 228 are attached. These rods 226, 228 are attached to the horizontal sliders 222, 224 such that the sock form 204 may move vertically along these rods 226, 228 and horizontally with the sliders 222, 224. In this manner, the sock form 204 can move horizontally to position itself over the then vertically disposed carrier 98, move downwardly to position the foot portion 210 of the sock form 204 in a sock, then move horizontally in an opposite direction to move away from the carrier 98 and then move vertically once again into the initial position. Nevertheless, it will be appreciated by those skilled in the art that the present invention is configured for further processing of the boarded sock and, therefore, any manner of sock movement may be anticipated to achieve the desired result with the sock, once boarded.

As previously stated, the present invention is controlled by a microcomputer 270 which accepts control signal inputs from the various photocells 240, 250, 252 to identify the position of the sock along the path of movement 21. These control signals are then processed by the microcomputer 270 in a manner which will activate the necessary piston/cylinder arrangements 122, 134, 158, 178, 196, 212 to cause various movements throughout the subsystem to maintain the orderly progression of the boarding process.

Figure 1A:
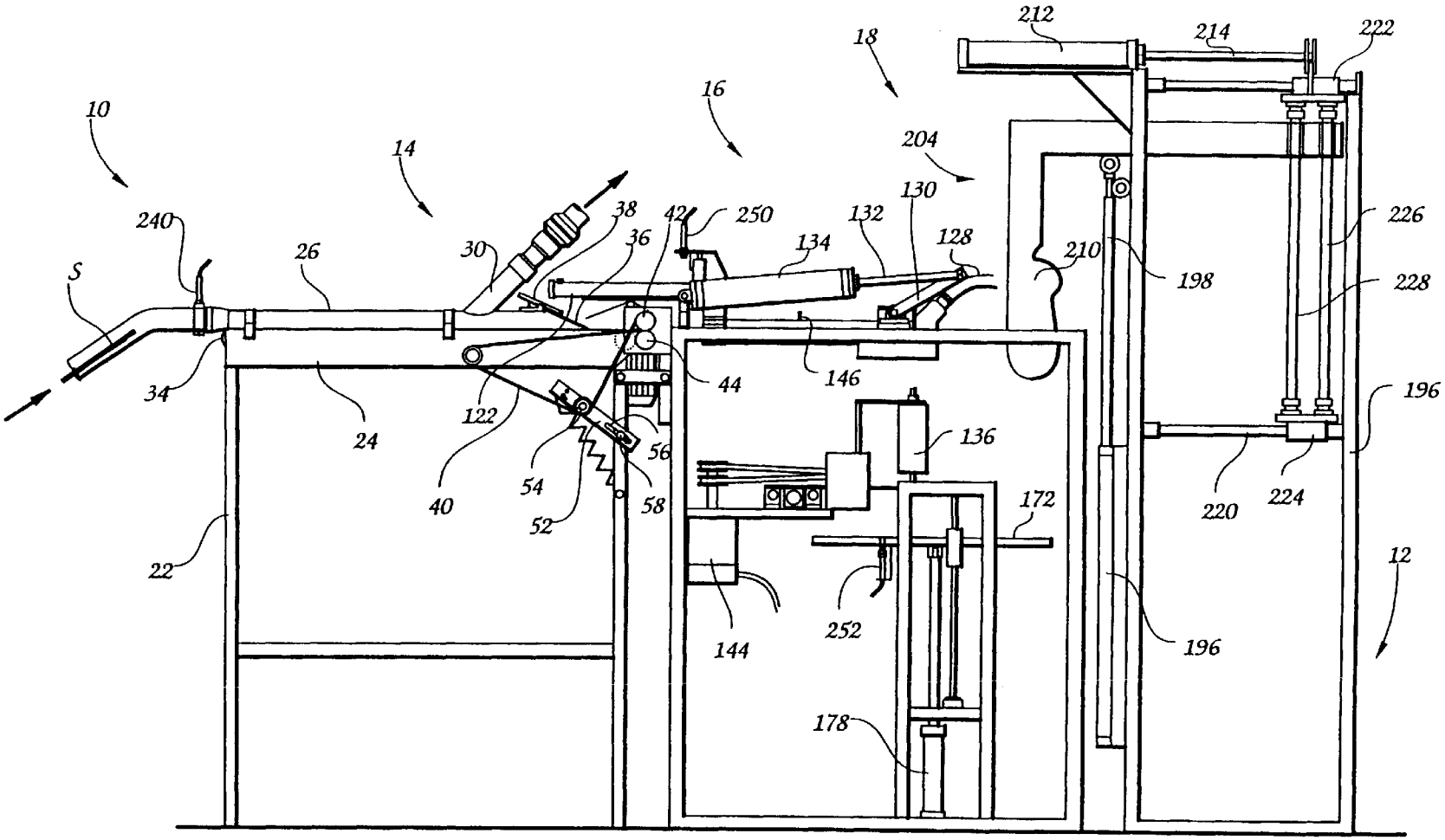
FIG. 1*a* is a side view of the sock boarding apparatus illustrating a sock at the entrance to the apparatus.
Figure 16:
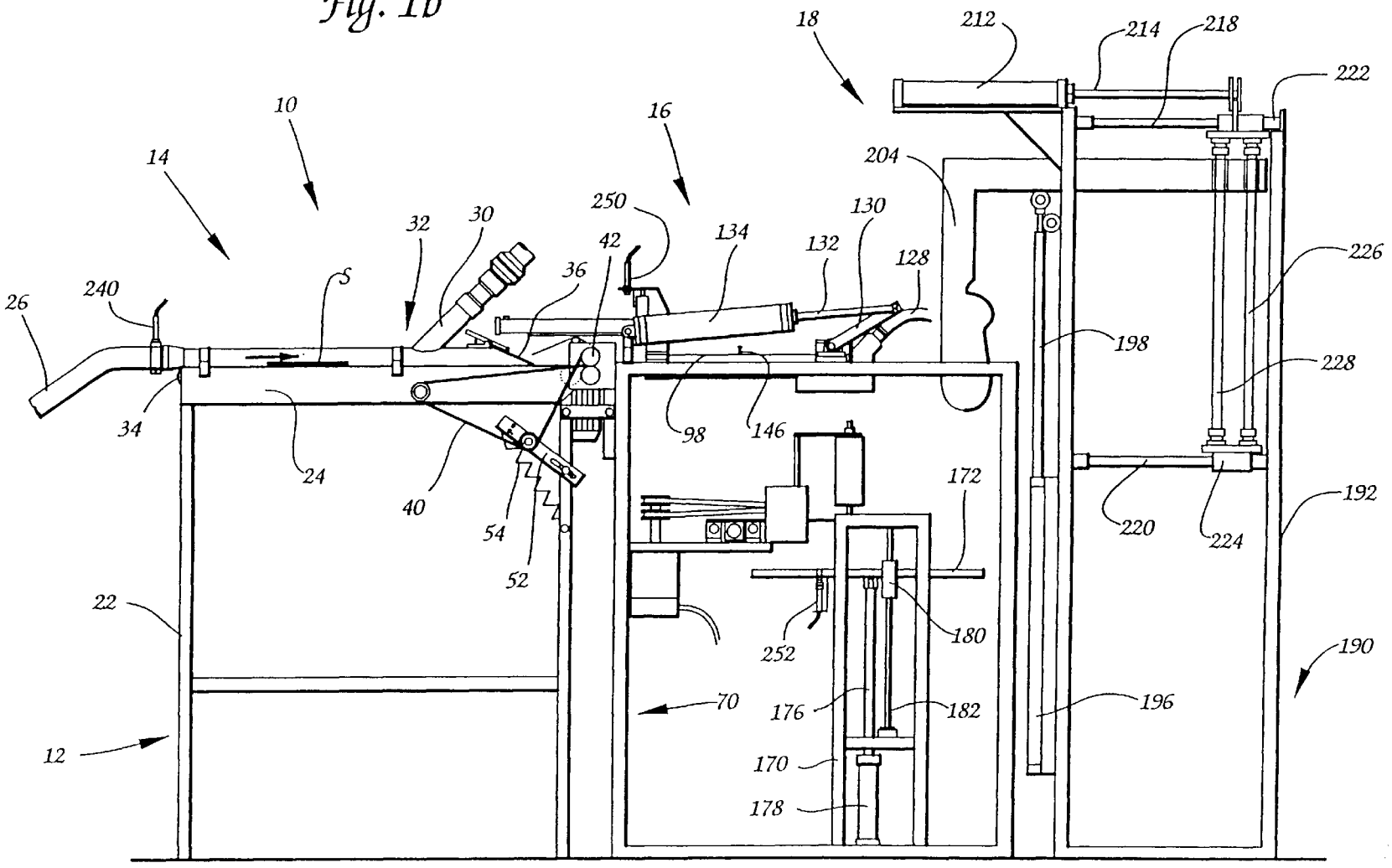
Figure 1C:
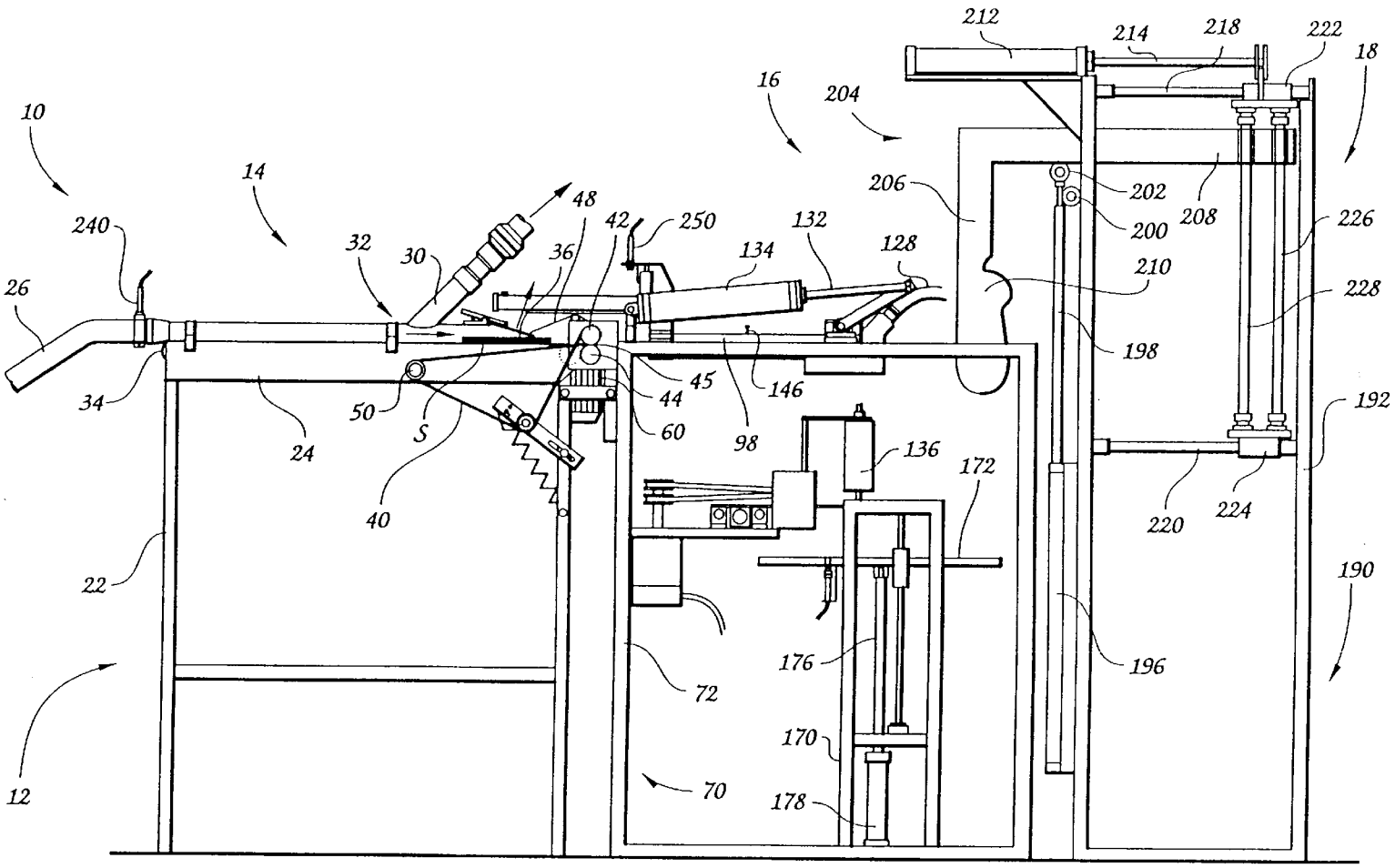
FIG. 1*c* is a side view of the apparatus illustrated in FIG. 1*b* with the sock exiting the delivery tunnel.
Figure 1D:
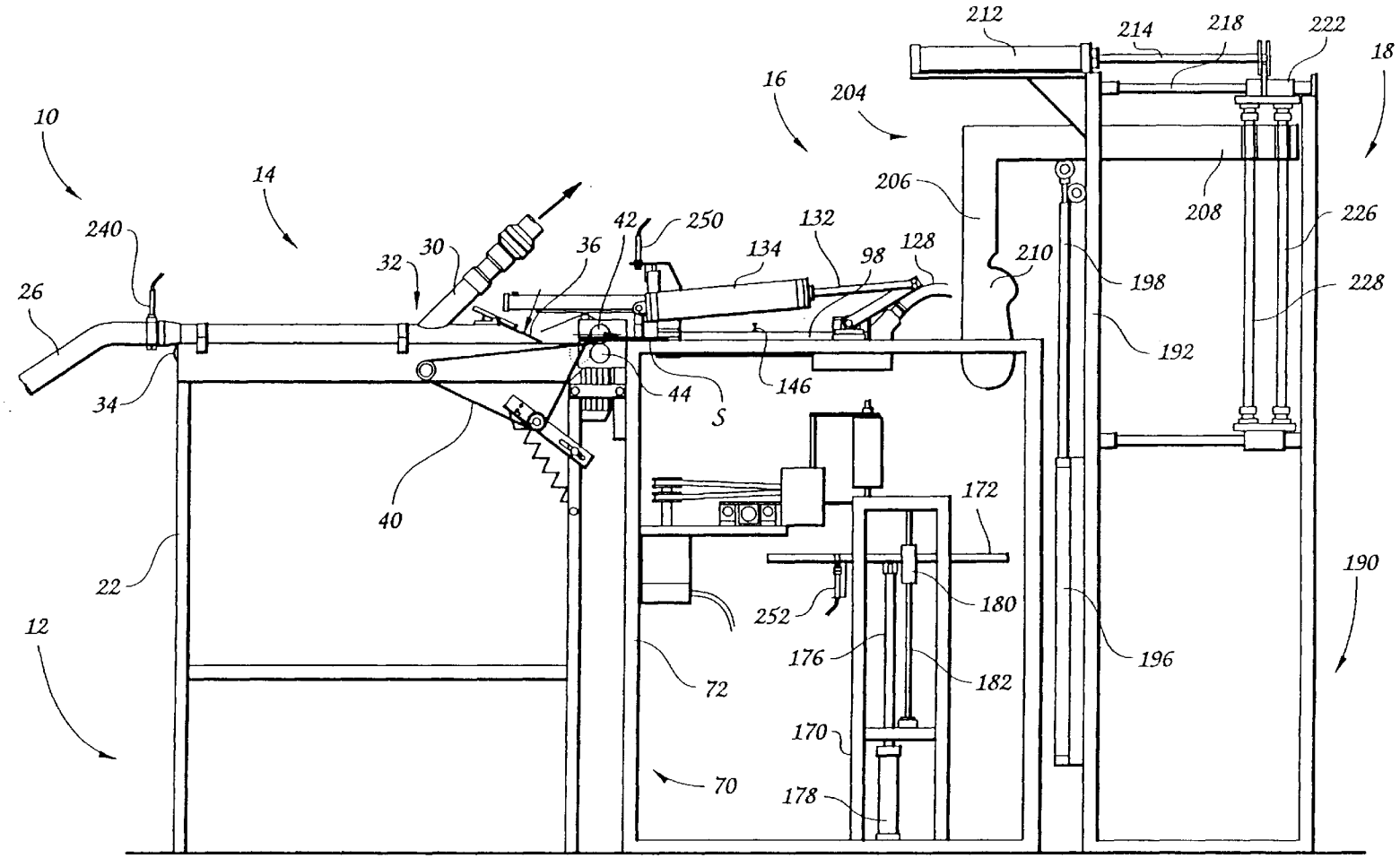
FIG. 1*d* is a side view of the apparatus illustrated in FIG. 1*c* with the sock exiting the delivery subsystem and entering the positioning subsystem.
Figure 1E:
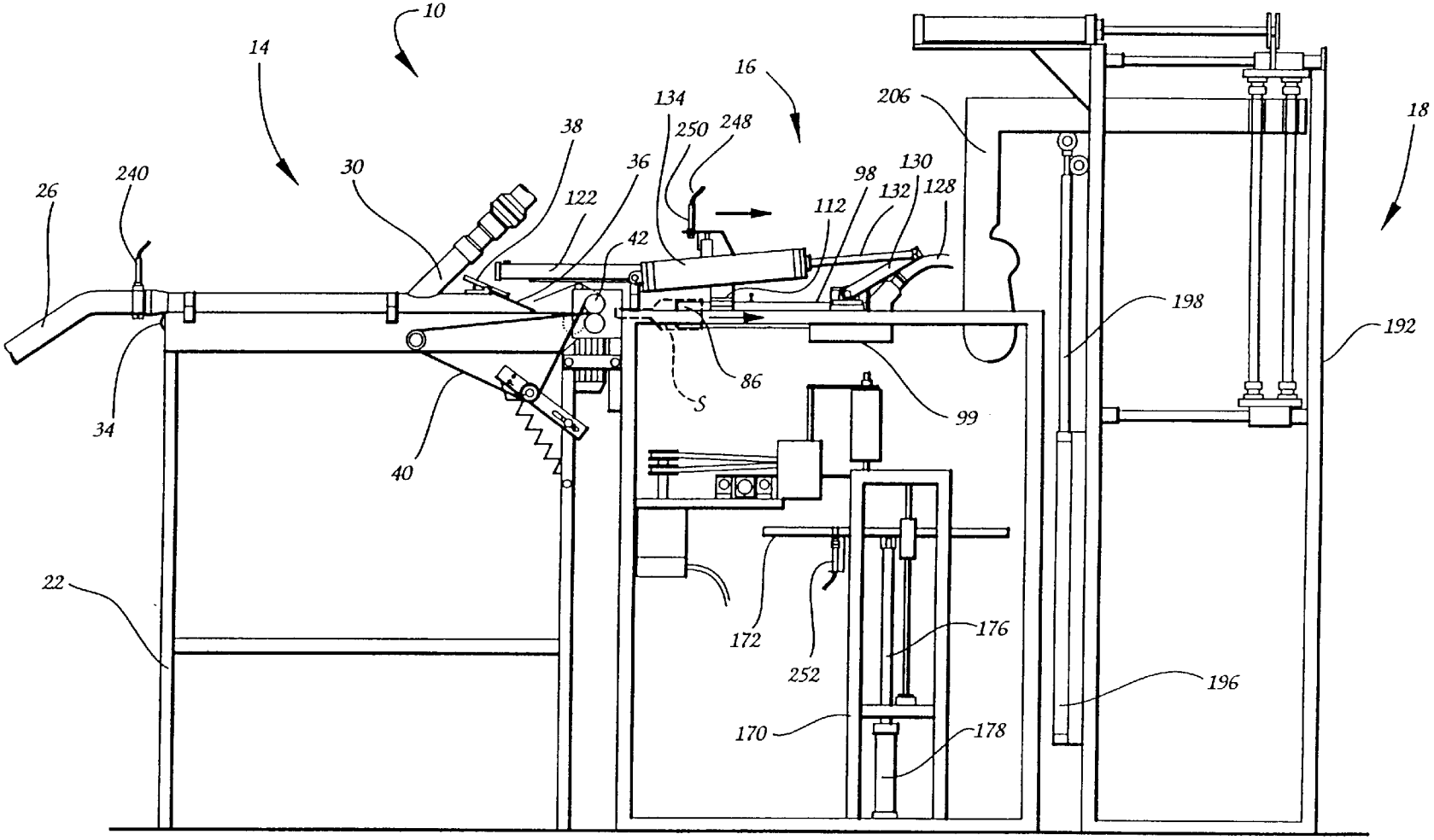
FIG. 1*e* is a side view of the apparatus illustrated in FIG. 1*d* with the sock being opened by the opening unit.

In operation, and with references to FIGS. 1*a*–1*l*, and with initial reference to FIG. 1*a*, a sock S is fed into the entrance to the delivery tunnel 26 with vacuum being applied through vacuum tube 30 to create a negative pressure within the delivery tunnel 26. As the sock S passes by the first photocell 240, it is recognized and the microcomputer 270 causes the conveyor 34 to activate and the sock S is propelled along the conveyor 34 as best seen in FIG. 1*b*. With reference to FIG. 1*c*, the sock S abuts the vacuum door 36 which causes it to open. The opening limiter bracket 48 limits movement of the door to preserve vacuum integrity for entrance of another sock into the delivery tunnel 26. Once out of the delivery tunnel 26, the conveyor 34 carries the sock S to the first pair of nip rolls 42, 44. These nip rolls 42, 44 will cause the sock S to exit the delivery assembly 14. With reference to FIG. 1*d*, the sock S is shown transiting the distance between the delivery subframe 14 and the positioning subframe 16. As previously described, this is where the opening unit 80 cooperates with the nip rolls 42, 44 to open the sock for positioning on the carrier 98.

Figure 1F:
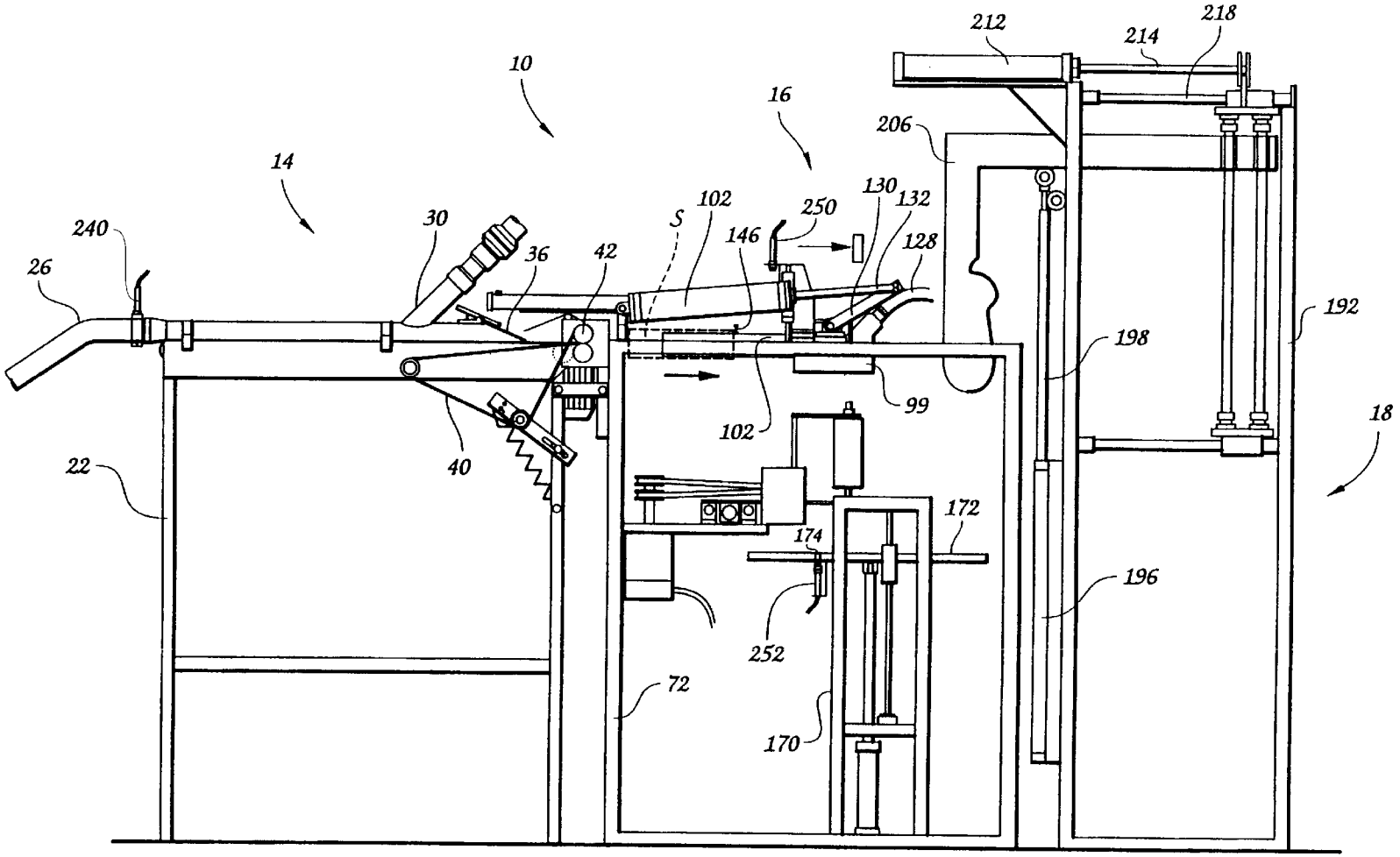
FIG. 1*f* is a side view of the apparatus illustrated in FIG. 1*e* with the sock being placed on the sock carrier.
Figure 1G:
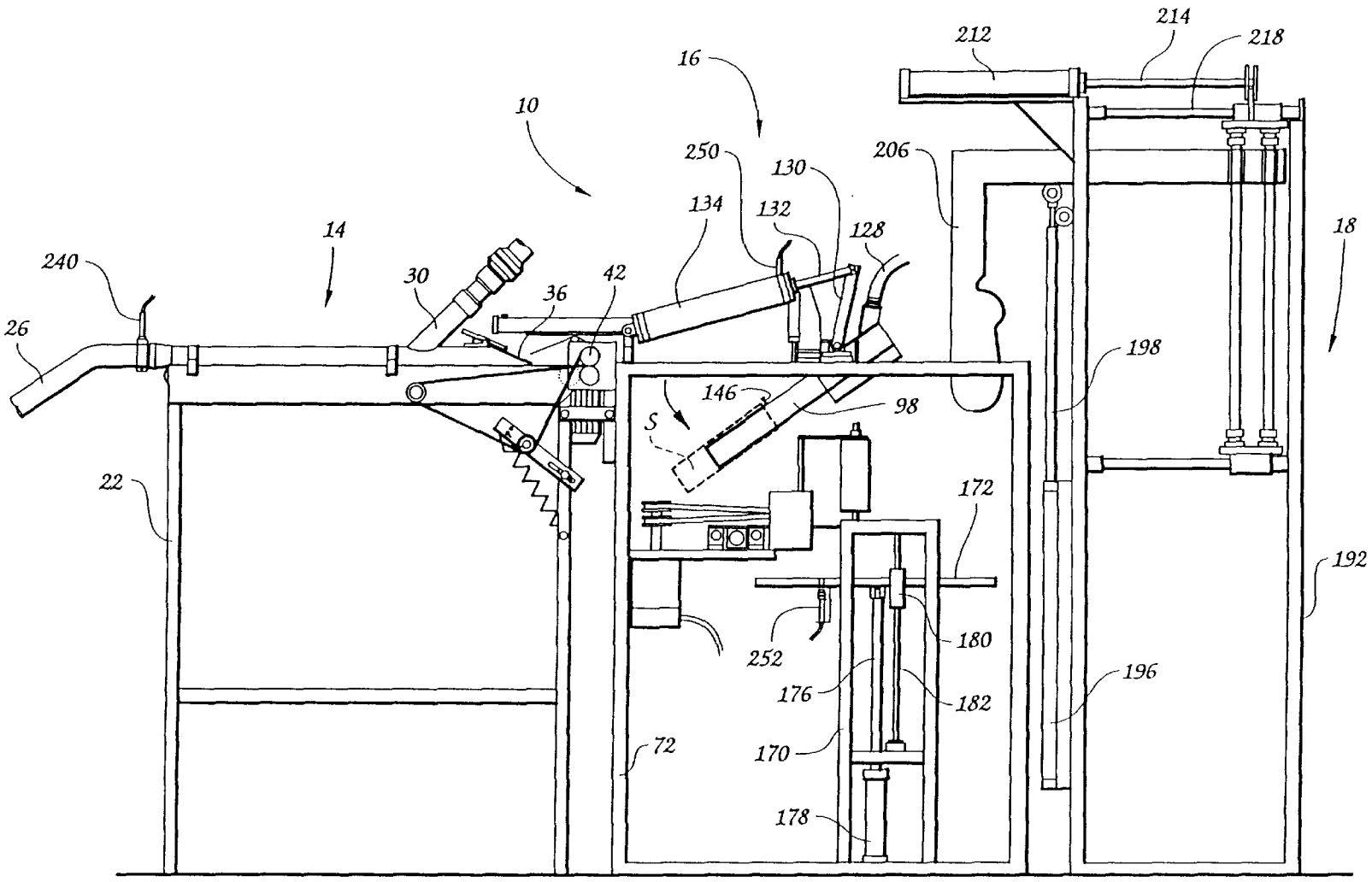
FIG. 1*g* is a side view of the apparatus illustrated in FIG. 1*f* with the carrier pivoting between the first and second positions.
Figure 5A:
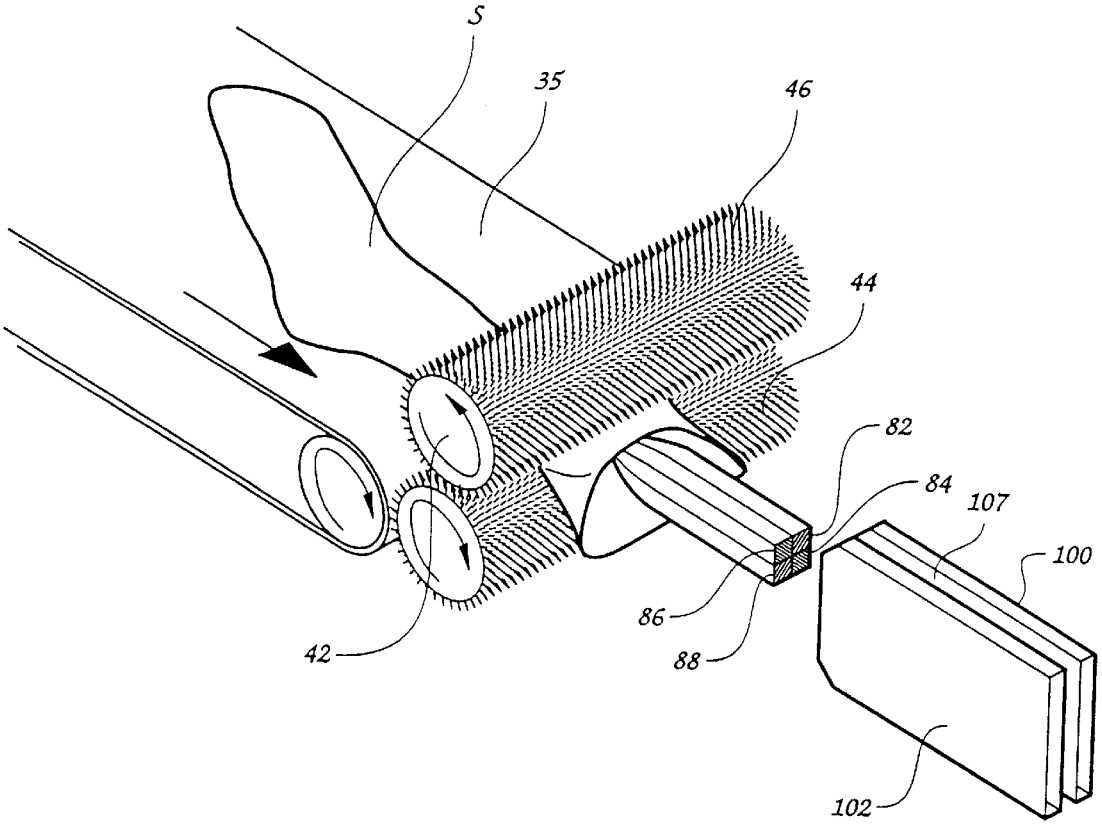
FIG. 5*a* is a sock being opened by the nip rolls illustrated in FIG. 5.
Figure 56:
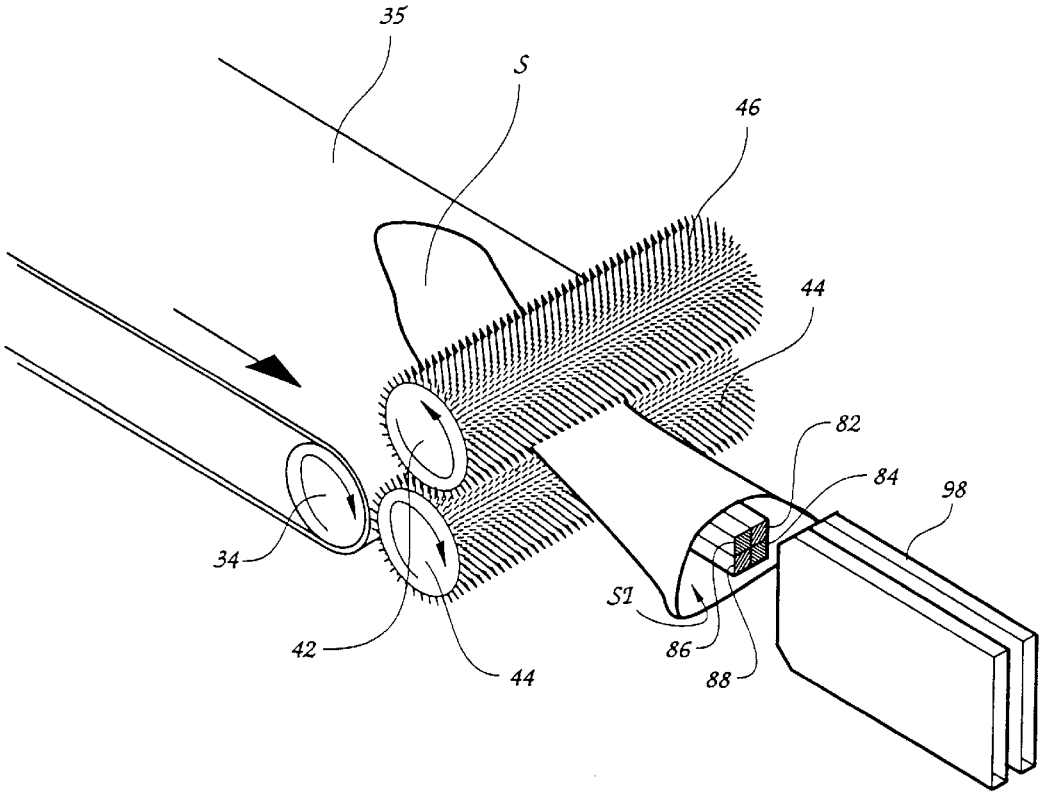
Figure 5C:
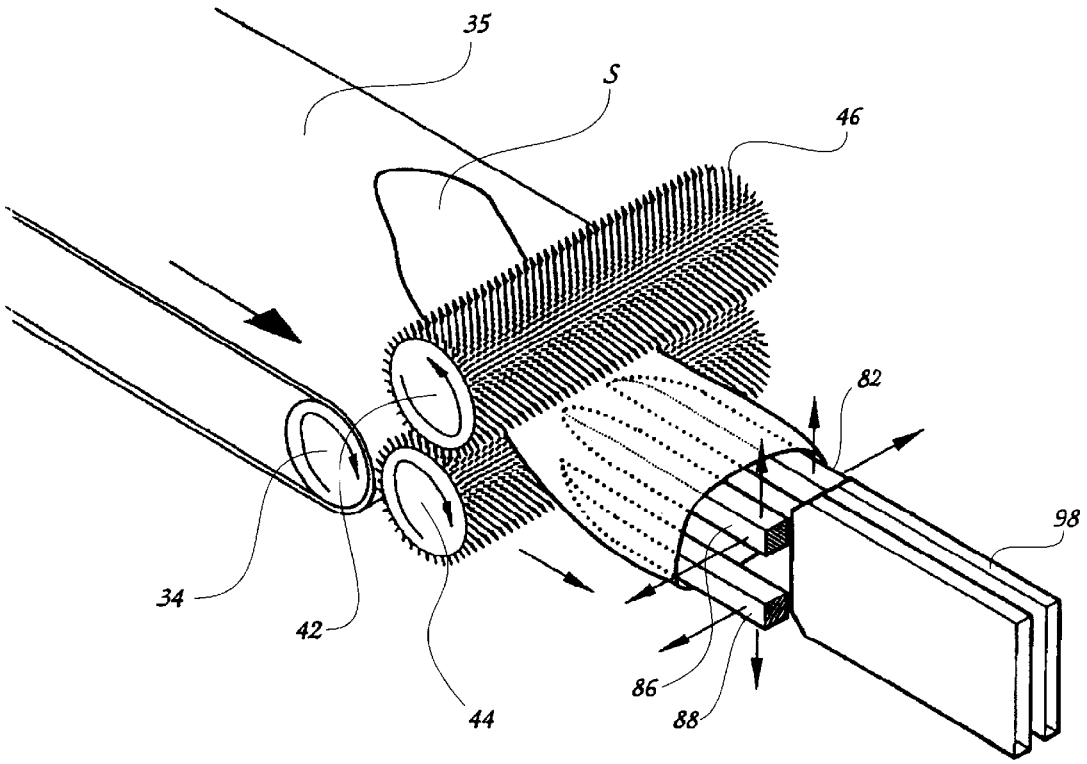
FIG. 5*c* is a perspective view of the opening unit opening a sock being delivered through the nip rolls.
Figure 5D:
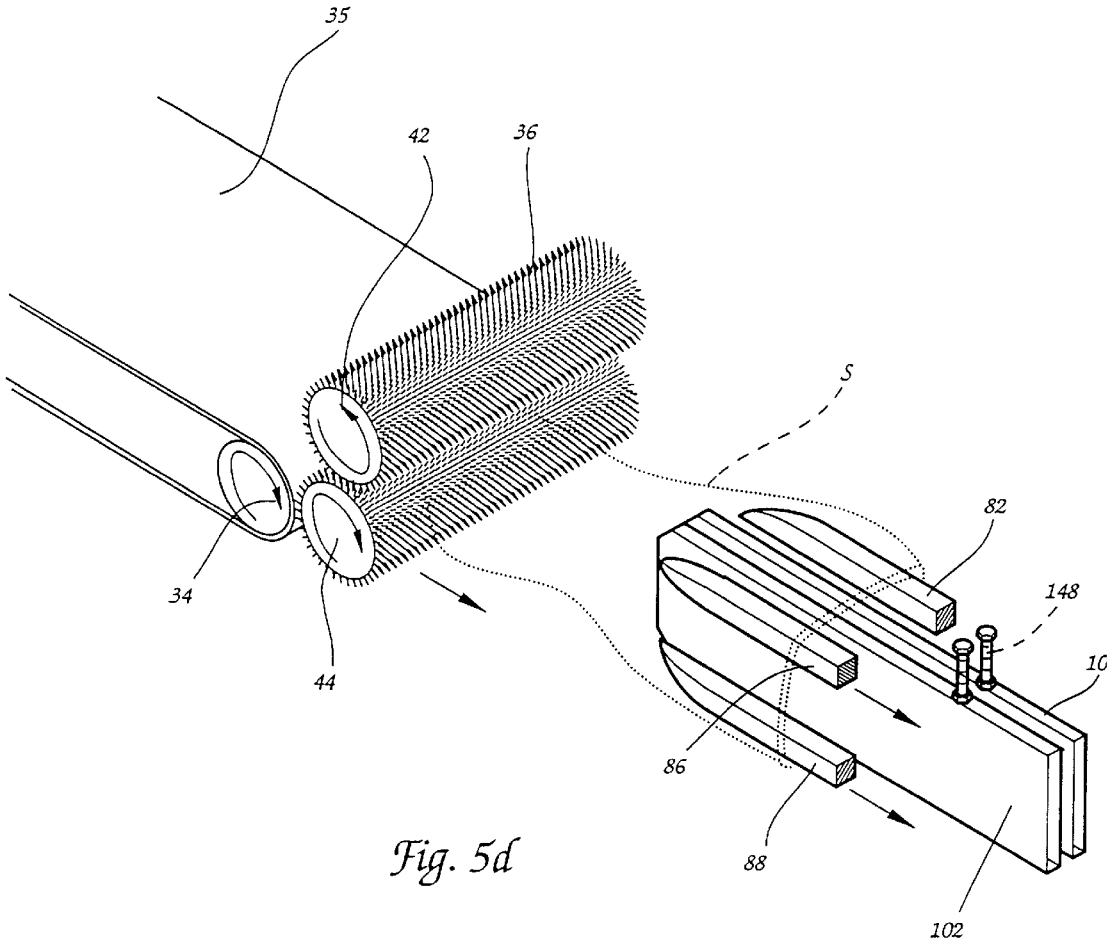
FIG. 5*d* is a perspective partial view of the opening unit placing the sock on the sock carrier.
Figure 5E:
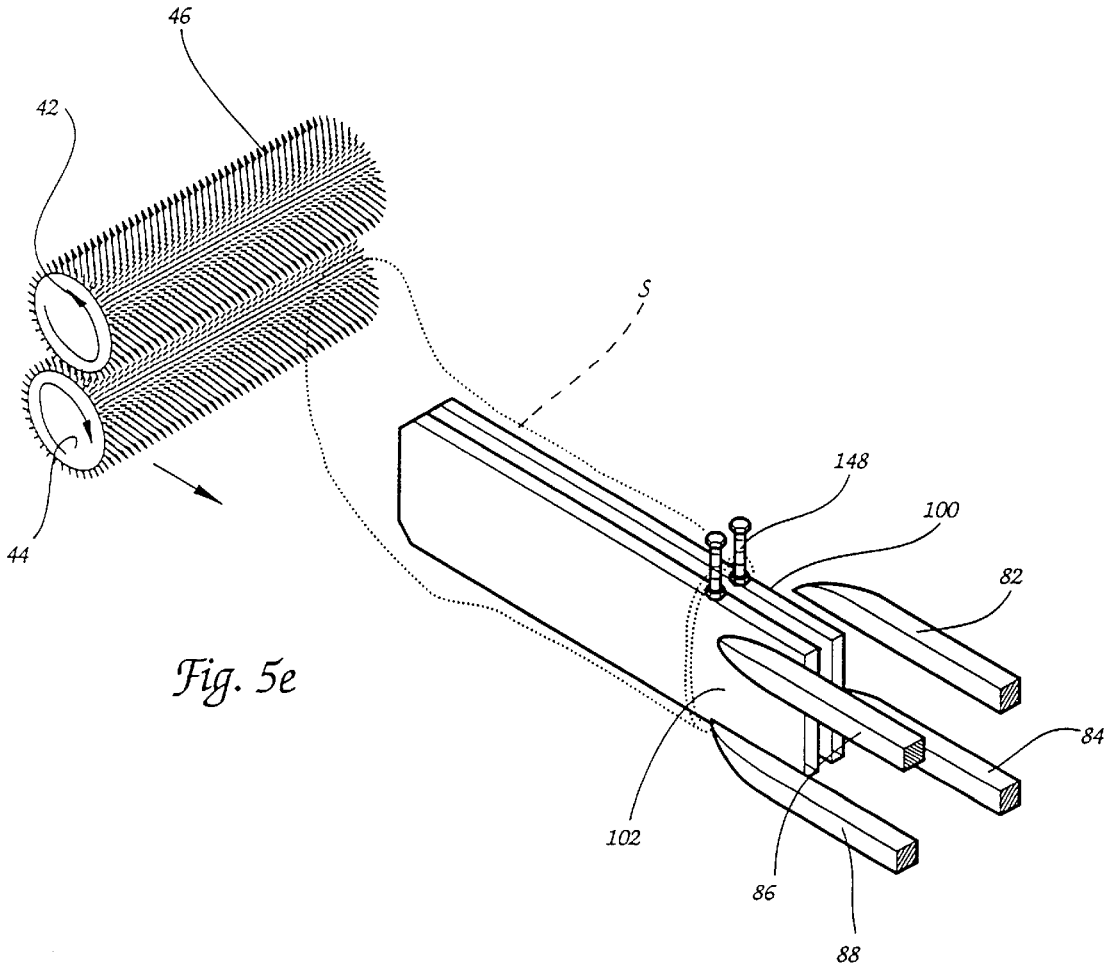
FIG. 5*e* is a perspective diagrammatic view of the opening unit being withdrawn from the sock which remains on the carrier.

With reference to FIG. 5, the sock S approaches the nip rolls 44, 46 on the conveyor belt 35. The sock S is captured by the nip rolls 42, 44 as seen in FIG. 5*a*, with the textured surface 46 acting to spread the open portion of the sock as it is advanced between the rolls 42, 44. The arms 82, 84, 86, 88 associated with the opening unit 80 are, at this point, tightly configured against one another to allow the sock S to be moved thereonto by the nip rolls 42, 44. As seen in FIG. 5*b*, the arms 82, 84, 86, 88 are moved into the sock interior SI. Once the sock S reaches a position underneath the photocell 250, the photocell 250 senses the position of the sock and transmits a signal to the microcomputer 270 to actuate the opening unit 80. The microcomputer 270 causes the piston/cylinders 116, 118 to move their respective control rods 170, 122 to cause the arms 82, 84, 86, 88 to spread mutually away from one another to thereby open the sock S as best seen in FIG. 5*c*. Once the opening unit 80 has spread the arms 82, 84, 86, 88 to their maximum separation position, the microcomputer 270 acts to cause the opening unit piston/cylinder 122 to cause the slider 112 associated with the opening unit 80 to move away from the receiving position as seen in FIG. 5*d*. As this occurs, the sock S will eventually abut stop members 148 as seen in FIG. 5*e* thereby doffing the sock from the arms 82, 84, 86, 88 and leaving the sock S retained on the carrier as seen in FIG. 5*e*. This relationship is also seen in FIG. 1*f*. Once the sock has reached this position, the microcomputer 270 activates the piston/cylinder 134 associated with the carrier 98 to retract its control rod 132, thereby transmitting this movement to link 130. Since the piston/cylinder 134 and the link 130 are pivotally mounted to positioning the subframe 70, this causes the link 134 to rotate, thereby rotating the carrier 98 into a vertically extending position with this movement being illustrated in FIG. 1*g*.

Figure 1H:
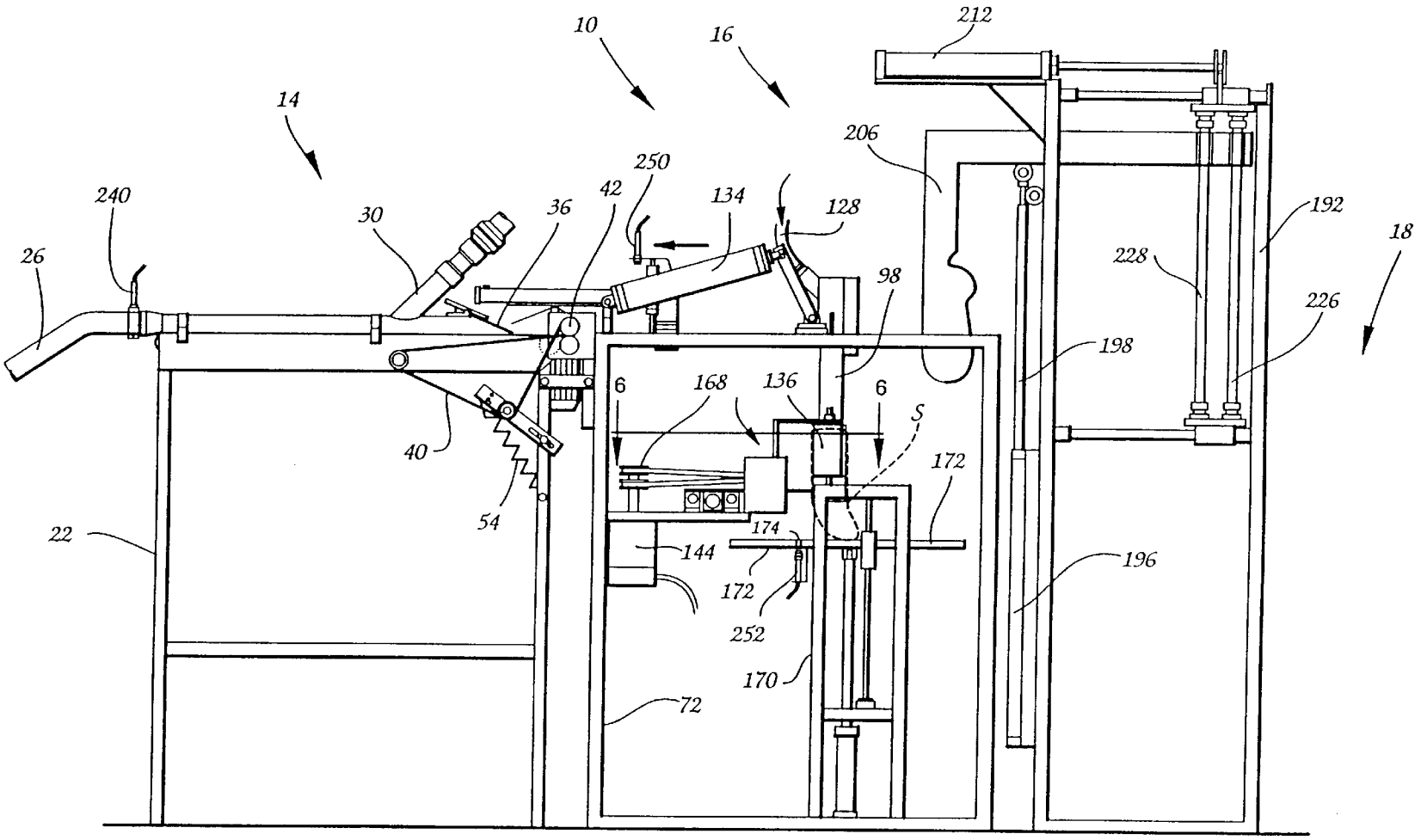
FIG. 1*h* is a side view of the apparatus illustrated in FIG. 1*g* with the sock being inflated on the carrier.
Figure 1I:
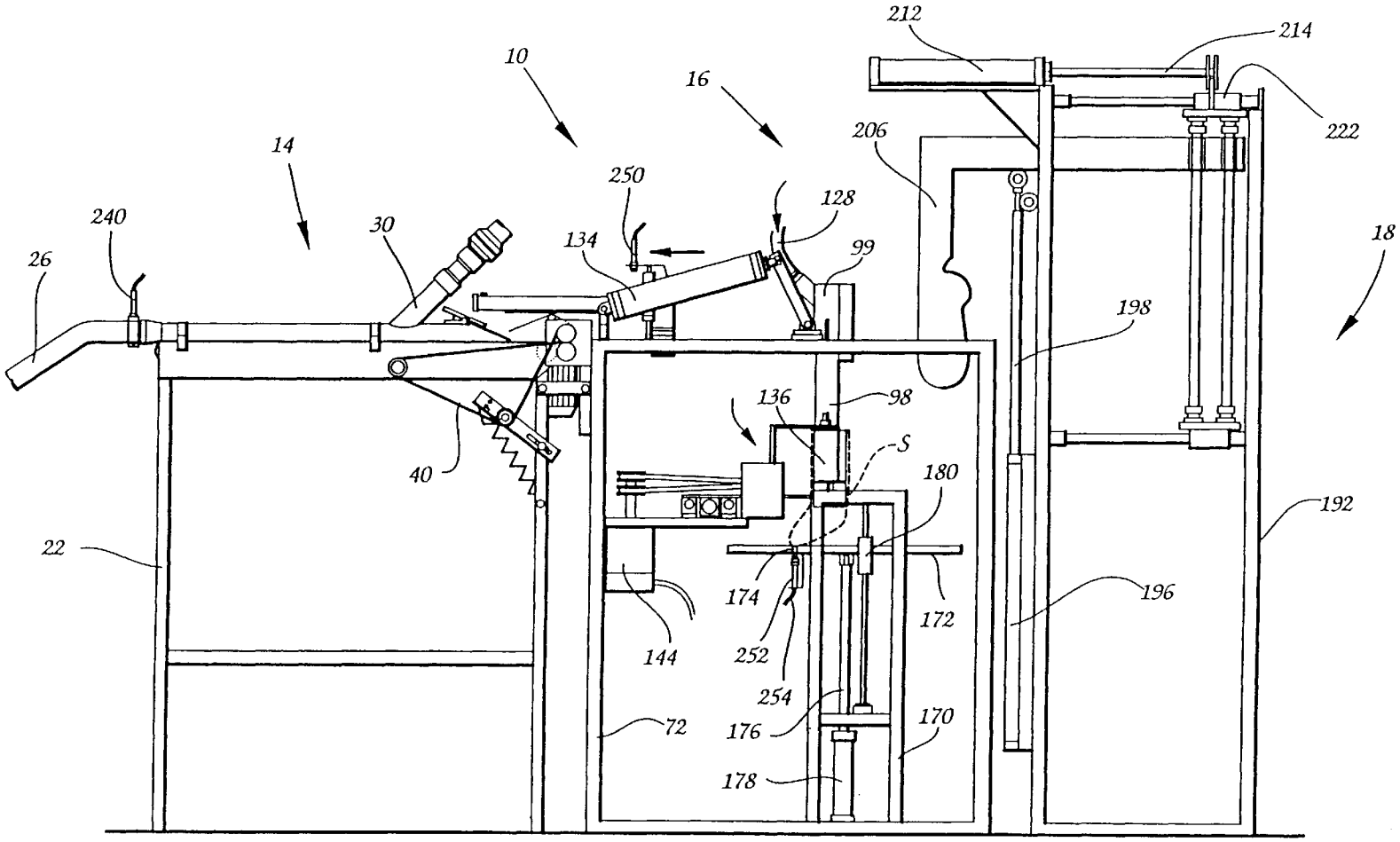
FIG. 1*i* is a side view of the apparatus illustrated in FIG. 1*h* with the sock being rotated on the carrier to position the sock for boarding.
Figure 1J:
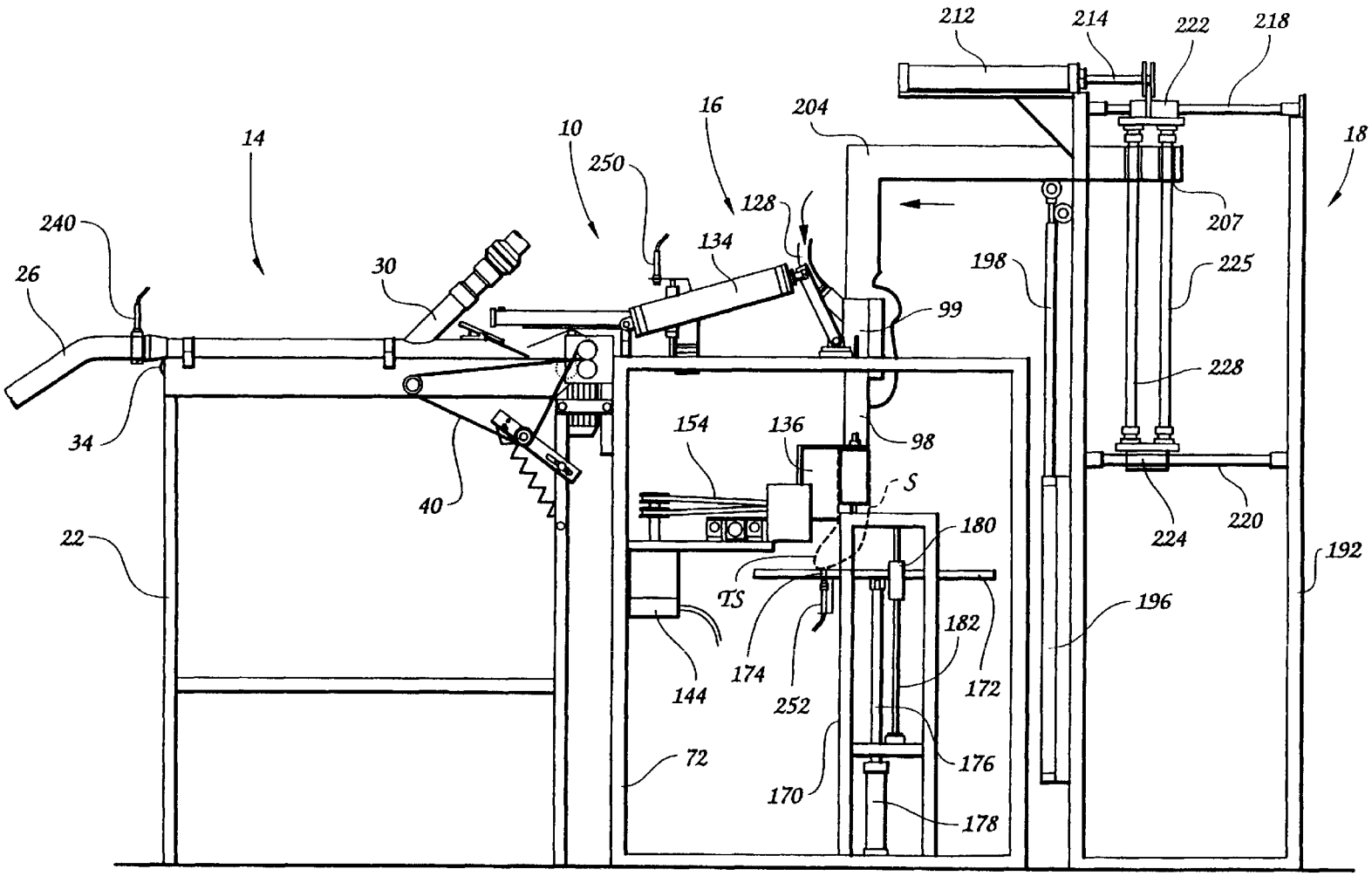
FIG. 1*j* is a side view of the apparatus with the sock board advancing over the carrier.
Figure 1K:
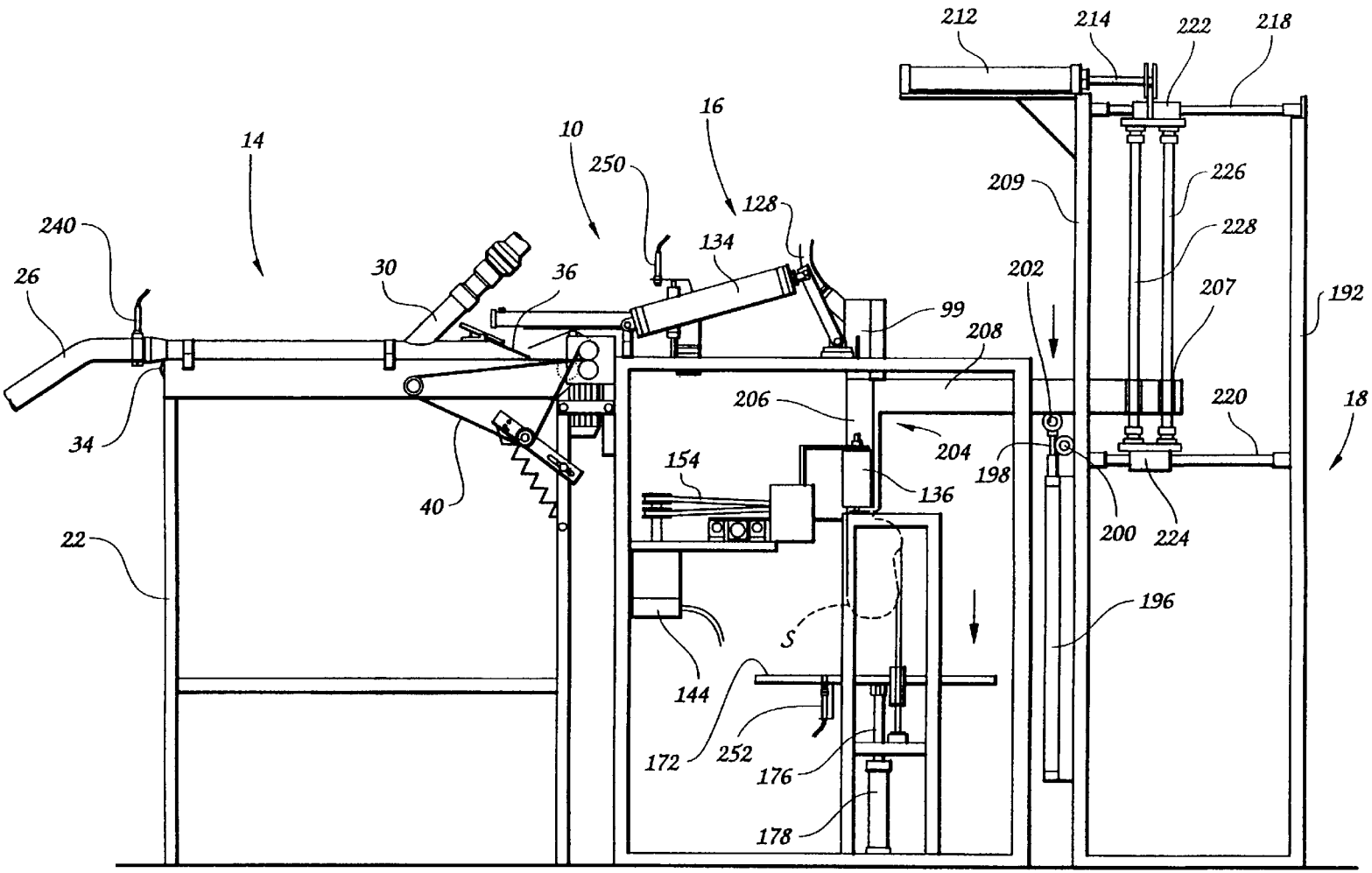
FIG. 1*k* is a side view of the apparatus illustrated in FIG. 1*j* with the sock board inserted into the sock.
Figure 1C:
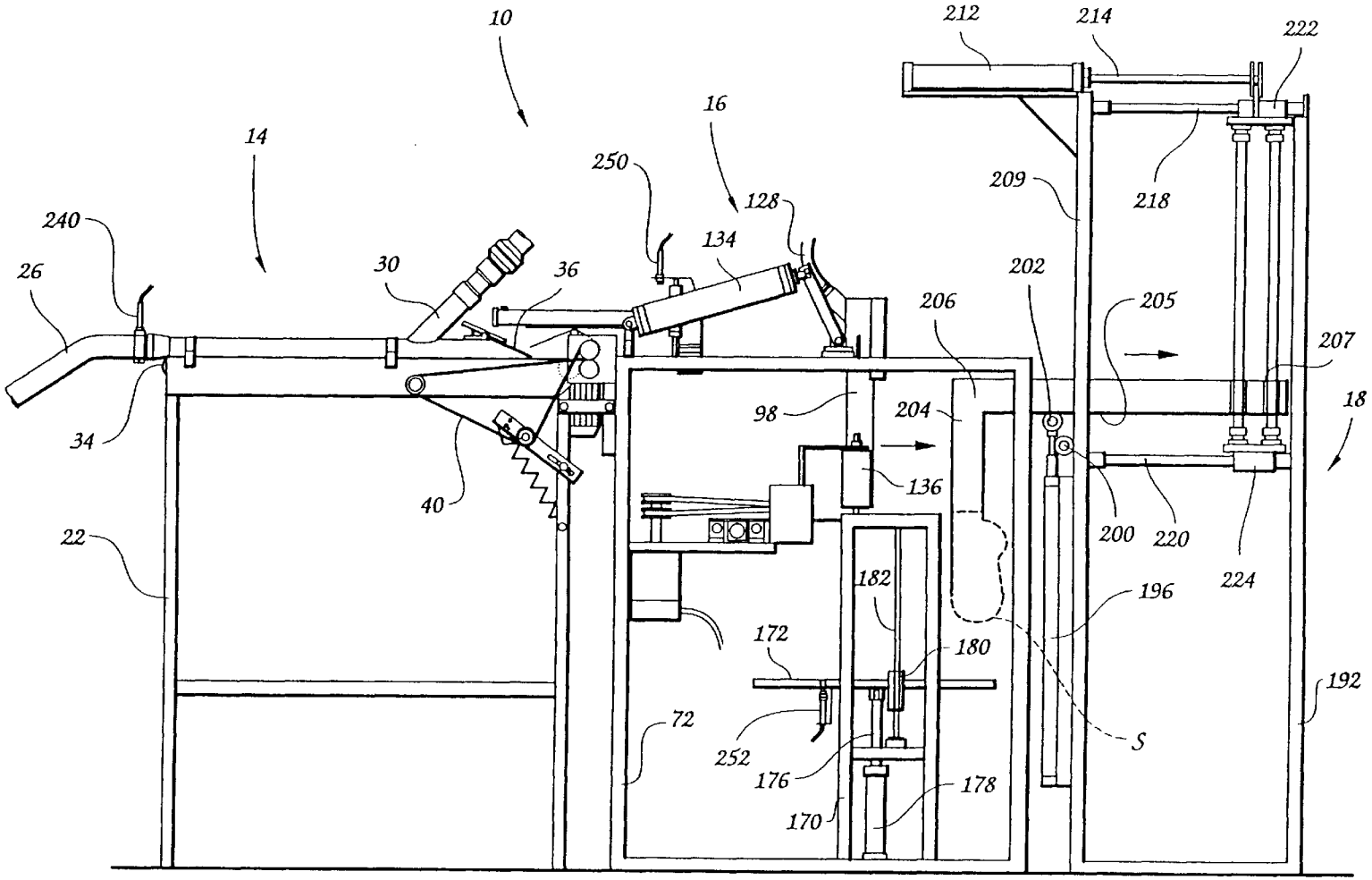

As seen in FIG. 1*h*, the sock S is now in a vertical arrangement and is inflated with air from the air supply (not shown). Once the carrier 98 has achieved a vertical position, piston cylinder 158 is activated, thereby drawing the positioning rolls 136, 138 toward one another and in contact with the sock. The positioning rolls 136, 138 are also caused to rotate by activation of the electric motor 144 and since they rotate in the same direction, the sock is caused to rotate, as seen in FIGS. 7, 7*a*, and 7*b*. Once the sock is positioned over the aperture 174 in the platform 172, photocell 252 senses the presence of the sock S thus emitting a signal to cause the microcomputer 270 to halt rotation of the positioning rolls 136, 138 and the reactivation of piston cylinder 158 to withdraw the rolls from the sock S. This situation is illustrated in FIG. 1*i*. The positioning of the sock S over the opening 174 and the platform 172 causes the microcomputer to activate piston/cylinder 112 which draws its control rod 214 inwardly, thereby causing the slider 222 to move horizontally along the slider rod 218 to move the sock board 204 into a position over the sock and intermediate the carrier members 100, 102. Once this limit has been achieved, and as seen in FIG. 1*k*, the microcomputer causes piston/cylinder 196 to withdraw its control rod 198, thereby causing the sock board 204 to descend into the sock S, thereby boarding the sock S.

Once the sock S is boarded, as seen in FIG. 1*l*, the microcomputer 270 causes the horizontal piston/cylinder 212 to move its control rod 214 outwardly, thereby moving the sock board 204 and the sock S now associated therewith away from the carrier 98. Once this occurs, the apparatus 10 may then reset itself to receive another sock and continue boarding operations.

It will be appreciated by those skilled in the art that the present invention must be capable of moving several socks in rapid succession throughout the process in order to keep pace with the machines which it serves. Therefore, certain portions of the machine will be reset to receive a consecutive stream of socks while operations are ongoing in other areas of the apparatus 10. Therefore, simultaneous activity may be occurring with one sock on the conveyor belt while another sock is being boarded by the boarding form. Additionally, it is contemplated that multiple carriers may be used along with multiple sock boards. Further, it is contemplated that other photocells may be disposed around the platform 172 to sense the position of the tow of the sock when the carrier reaches the vertical position to cause the positioning rolls to rotate in one direction or another to achieve the shortest distance to the boarding position. Accordingly, the present invention is capable of modification and adaptation in order to streamline the process and such modification and adaptation should not be construed as coming outside the scope and spirit of the present invention.

Figure 9:
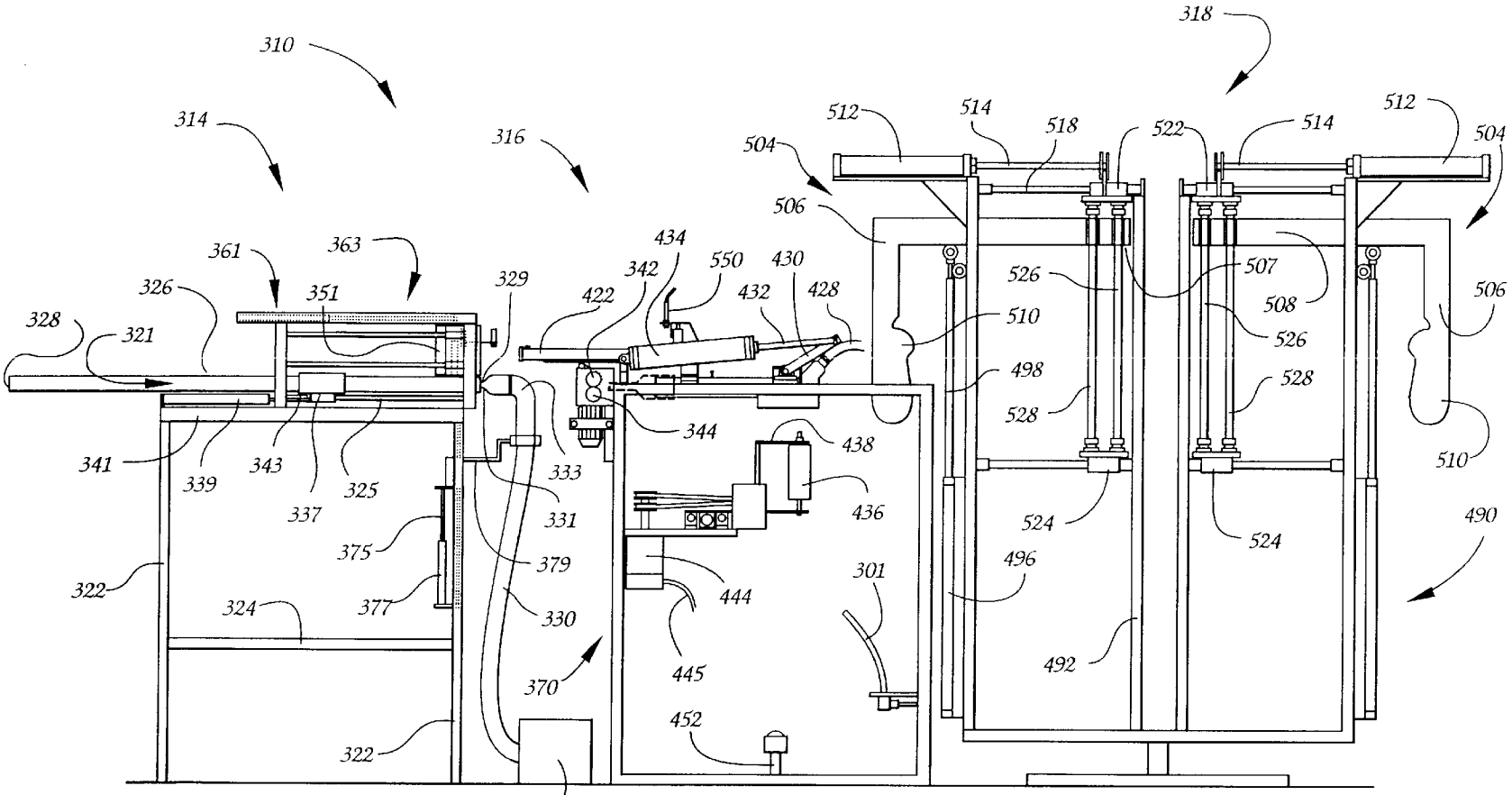
FIG. 9 is a side view of the apparatus for automatically boarding one or more socks according to the second preferred embodiment of the present invention.
Figure 10:
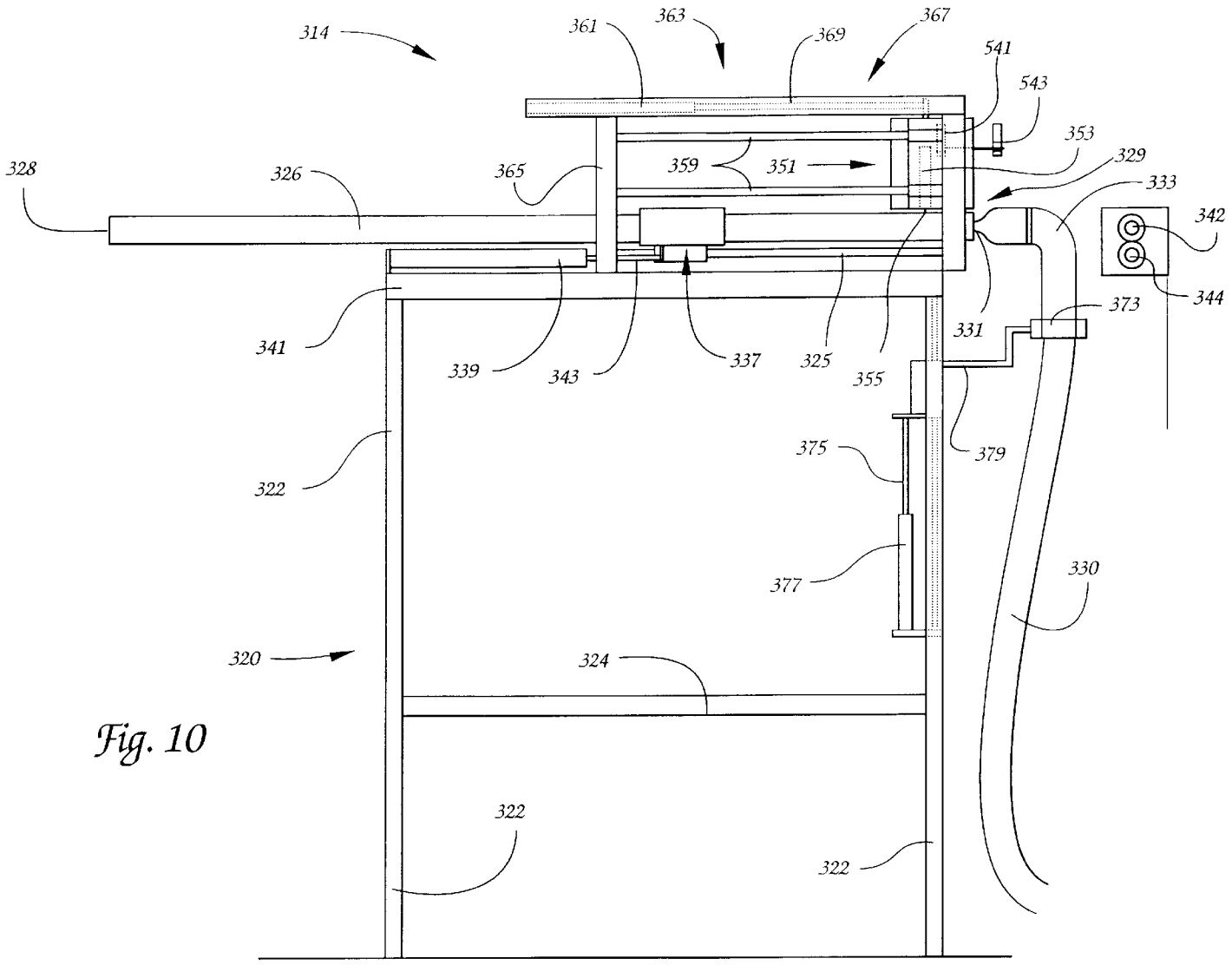
FIG. 10 is a side view of the delivery assembly according to the second preferred embodiment of the present invention.

An alternate preferred embodiment of the present invention is shown in FIGS. 9 and 10 and designated generally by the numeral 310. As in the first preferred embodiment, the alternate preferred embodiment includes three interrelated major subsystems or assemblies, each defined by a separate subframe, including a delivery assembly 314 having a delivery subframe 320, a positioning assembly 316 having a positioning subframe 370 and a boarding assembly 318 having a boarding subframe 490. Collectively, all of the subframes 320, 370, 490 form a skeletal framework 312 and define a path of movement 321 for one or more socks through the apparatus 310. The present invention of the second preferred embodiment includes several motors, piston and cylinder arrangements and an air system, all of which are controlled by the microcomputer 270 which is described with reference to the first preferred embodiment and illustrated generally in FIG. 1.

Referring specifically to FIG. 10, the delivery assembly 314 of the second preferred embodiment includes the delivery subframe 320 which includes a plurality of vertical support members 322 and horizontal support members 324 arranged to support various components of the delivery assembly 314. A transparent delivery tunnel or input tube 326 is provided and slidably mounted to a horizontal slide rod 325 mounted to the upper portion of the delivery subframe. At least one slider 337 is slidably mounted on the slide rod 325 and is connected to the input tube 326 such that the movement of the slider causes the horizontal movement of the input tube 326 relative to the delivery subframe 320. The slider 337 is actuated by a piston and cylinder arrangement 339 which is mounted to a horizontally extending support member 341 on the delivery subframe 320 and has a selectively extendable piston rod 343 connected to the slider 337 as shown in FIG. 10 for horizontal movement of the input tube 326 between a start position and an extended, end position. The input tube 326 has a generally rectangular shape and includes an entrance end 328 which receives the sock from the knitter or other apparatus and an exit end 329 from which the sock is discharged from the input tube 326 and delivered into a pair of nip rolls 342, 344.

A vacuum tube 330 is movably positioned at the exit end 329 of the input tube 326 between the exit end 329 and the nip rolls 342, 344 and is in fluid communication with a vacuum source 345 which will create a vacuum within the input tube 326 which rapidly draws the sock from the entrance end 328 to the exit end 329 of the tube. A piston and cylinder arrangement 377 is mounted to a vertically extending support member 322 as seen in FIGS. 9 and 10 and has a selectively extendable piston rod 375 connected to an operating arm 379. The operating arm 379 projects outwardly from the piston and cylinder arrangement 377 and is connected to the vacuum tube 330 by a holder 373 such that downward movement of the arm 379 causes the lowering of the vacuum tube 330 from a first, operational position to a second, non-operational position. The vacuum tube 330 extends upward from a vacuum source 345 located below the delivery subframe 320 and has a goose or curved neck 333 which terminates with a vacuum mouth 331. The vacuum mouth 331 disposed adjacent to and is directly aligned with the exit end to create a vacuum within said input tube 326 when the vacuum tube 330 is in the first, operational position. The vacuum mouth 331 is out of alignment with the exit end 329 and is positioned below the input tube 326 when the vacuum tube 330 is lowered to the second, non-operational position. When the vacuum tube 330 is in the first position, the vacuum mouth 331 and neck 333 are positioned directly between the exit end 329 of the input tube 326 and the nip rollers 342, 344. As will be described in greater detail hereinafter, when the vacuum tube 330 is in the second position, the input tube 326 moves forward toward the nip rolls 342, 344 to fill the gap left by the vacuum tube 330 between the exit end 329 and the nip rolls 342, 344 so that the exit end 329 is directly adjacent to the nip rolls 342, 344.

The delivery assembly 314 of the second preferred embodiment also includes an assembly for engaging and retaining one or more socks disposed at the exit end 329. The assembly includes a stop member positioned near the exit end 329 of the input tube 326 which prevents the sock from being completely drawn into the vacuum tube 330 and retains the sock at the exit end 329. The stop member includes a plunger cylinder 351 having a piston and cylinder arrangement 353 which controls the vertical movement of a plunger 355 moveably attached thereto, between a retracted position and an extended position. The piston and cylinder arrangement 353 is mounted within the plunger and cylinder arrangement 351 and includes a selectively extendable piston rod attached to the plunger 355. When actuated, the piston and cylinder arrangement 353 moves the plunger 355 downward from its retracted position to the extended position to contact the sock as it begins to exit the input tube 326 and is being drawing into the vacuum mouth 331 and retain it at the exit end 329 of the input tube 326 by pinning it to the bottom of the tube 326. The plunger cylinder 351 * is slidably connected to at least one slide rod 359 for horizontal movement thereon and is actuated by a piston and cylinder arrangement 361 connected to the plunger cylinder 351. As shown in FIG. 10, the slide rod 359 is mounted on a subframe 363 which extends above the input tube 326 and has vertical members 365 and horizontal members 367 on which the piston and cylinder arrangement 361 is horizontally mounted. The piston and cylinder arrangement 361 has a selectively extendable piston rod 369 attached to the plunger cylinder 351 which is adapted to slide on the slide rod 359. While the plunger 355 is in the extended position pinning the sock down, the piston and cylinder arrangement 361 is actuated causing the plunger cylinder 351 to slide horizontally along the slide rod 359 away from the exit end 329 so that the sock retained by the plunger 355 is pulled back into the input tube 326.

In the second preferred embodiment, a pair of sensors 541, 543 are disposed at the exit end of the input tube 326 for sensing movement of the sock and actuating the necessary piston and cylinder arrangements to cause various movements. A first sensor 541 is mounted on the subframe 363 adjacent to and immediately prior to the exit end 329 to sense the presence of the sock as it begins to proceed through the exit end 329 of the input tube 326 for production of a signal indicative of the presence of one or more socks along said path of movement. The first sensor 541 is in communication with the microcomputer 270 and causes the microcomputer to activate the plunger cylinder 351 to rapidly extend the plunger 355 downward to its extended position into contact with the sock to pin the sock to the bottom of the tube. With the plunger in the extended position, the piston and cylinder arrangement 361, activated by the microcomputer, causes the plunger cylinder 351 to slide back along the slide rod 359 away from the exit end 329 so that the sock is pulled back into the input tube 326. At the same time, the first sensor 541 also causes the vacuum source 345 to be shut off and actuates the piston and cylinder arrangement 377 of the vacuum tube 330 to lower the vacuum tube 330 from the first, operational position to the second, non-operational position. A second sensor 543 is mounted on the subframe 363 to project outward therefrom so that it is positioned adjacent to and immediately after the exit end 329 to sense the presence of the sock which is being pulled back into the tube 326 for production of a signal indicative of the absence of one or more socks as it is pulled into the input tube so that the end or absence of the sock at the exit end is detected by the second sensor 543. The second sensor 543 is in communication with microcomputer 270 and when it senses the end of the sock, causes the microcomputer to actuate the piston and cylinder arrangement 353 which is connected to the plunger 355 to retract the plunger to its retracted position and release the one or more socks retained by the plunger 355. The microcomputer also actuates the piston and cylinder arrangement 339 which is connected to the slider 337 attached to the input tube 326 for moving the input tube 326 forward to deliver the sock to the nip rolls 342, 344. As in the first preferred embodiment, the sensors 541, 543 are photocell or photoelectric sensors which send an electrical signal to the microcomputer 270 via wiring.

Figure 10A:
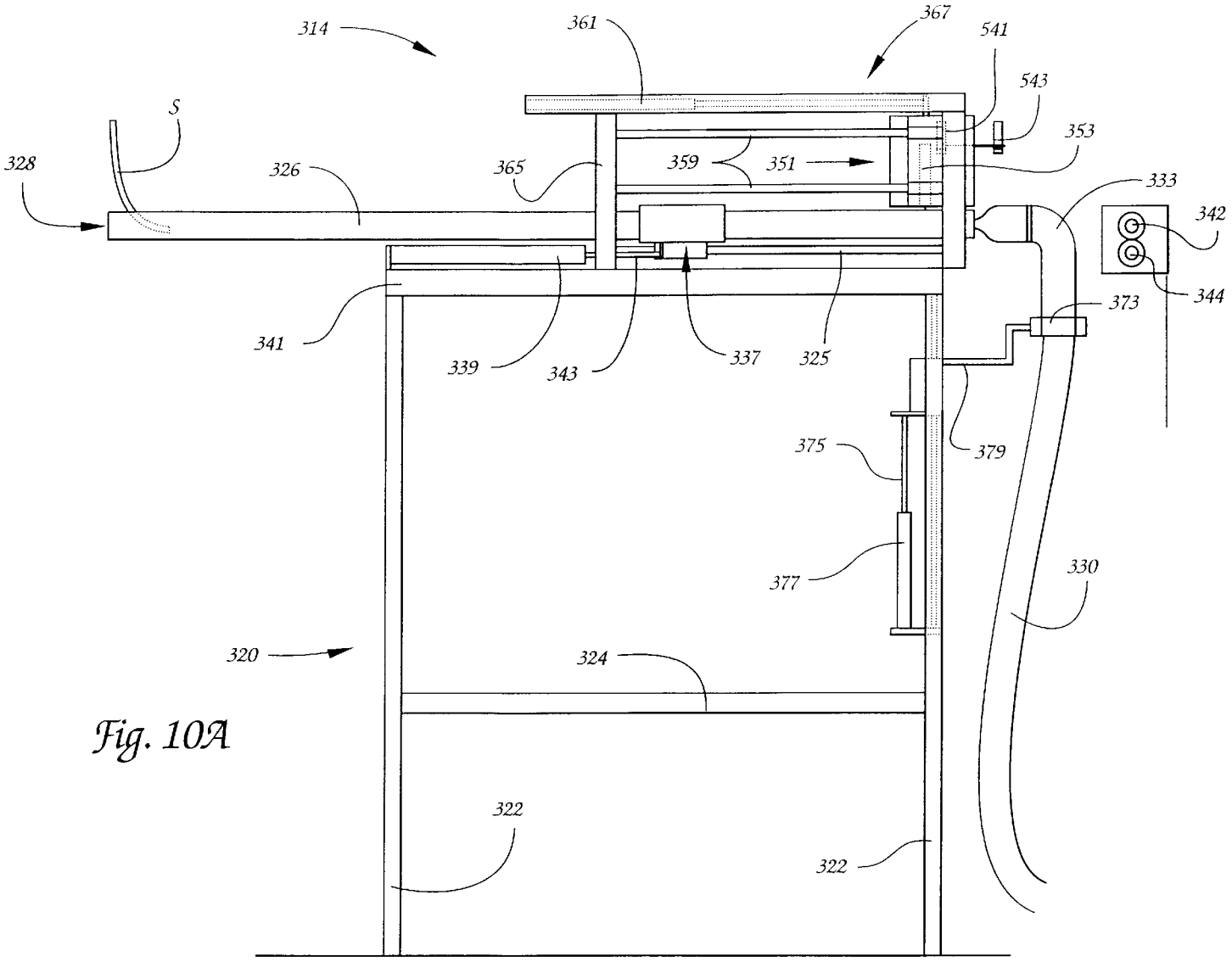
FIG. 10*a* is a side view of the sock boarding apparatus of FIG. 10 illustrating a sock at the entrance end of the apparatus.
Figure 10B:
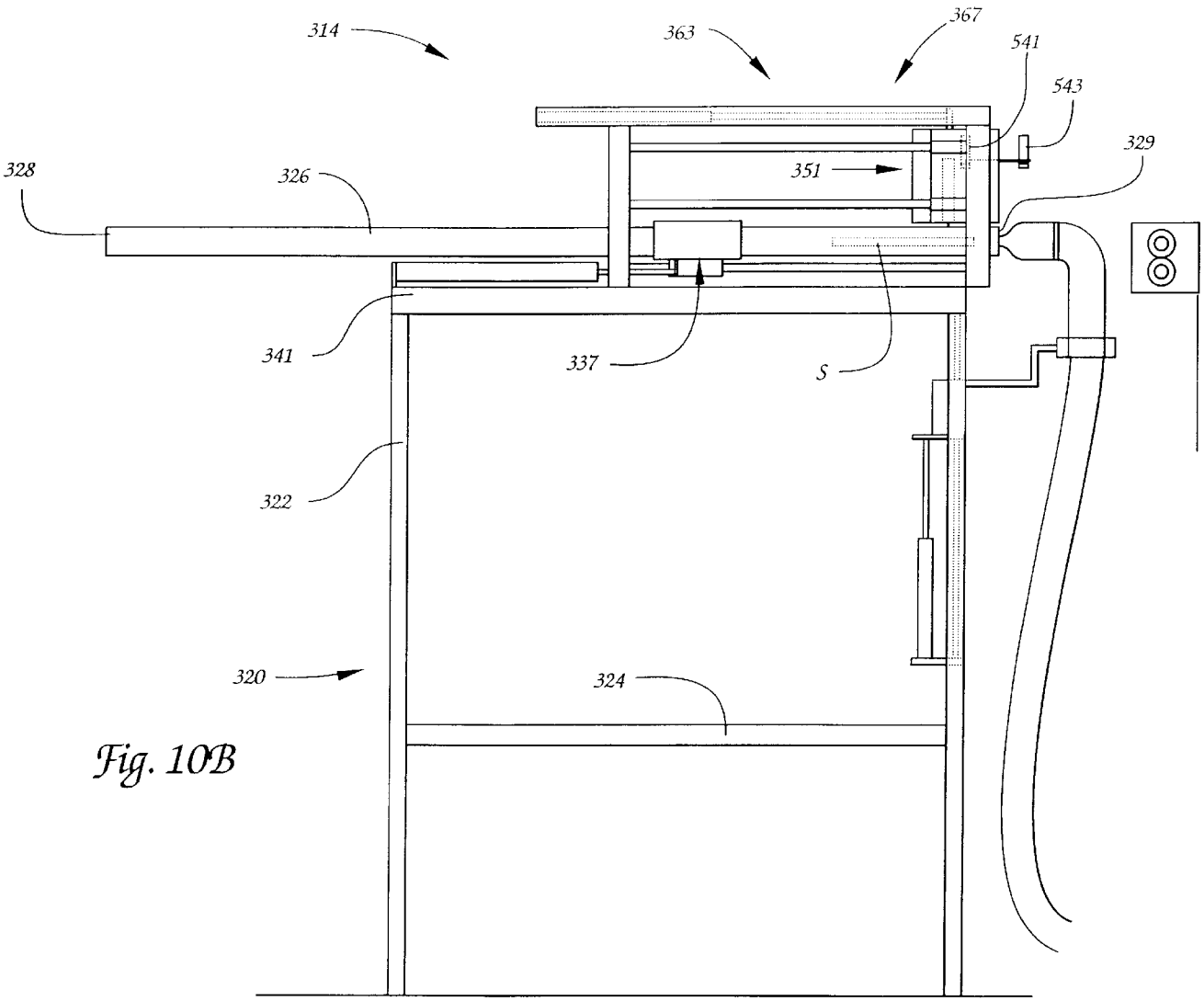
FIG. 10*b* is a side view of the apparatus illustrated in FIG. 10*a* with the sock having been drawn through the input tube and approaching the exit end of the tube with the vacuum tube positioned adjacent to the exit end at the first, operational position.
Figure 10C:
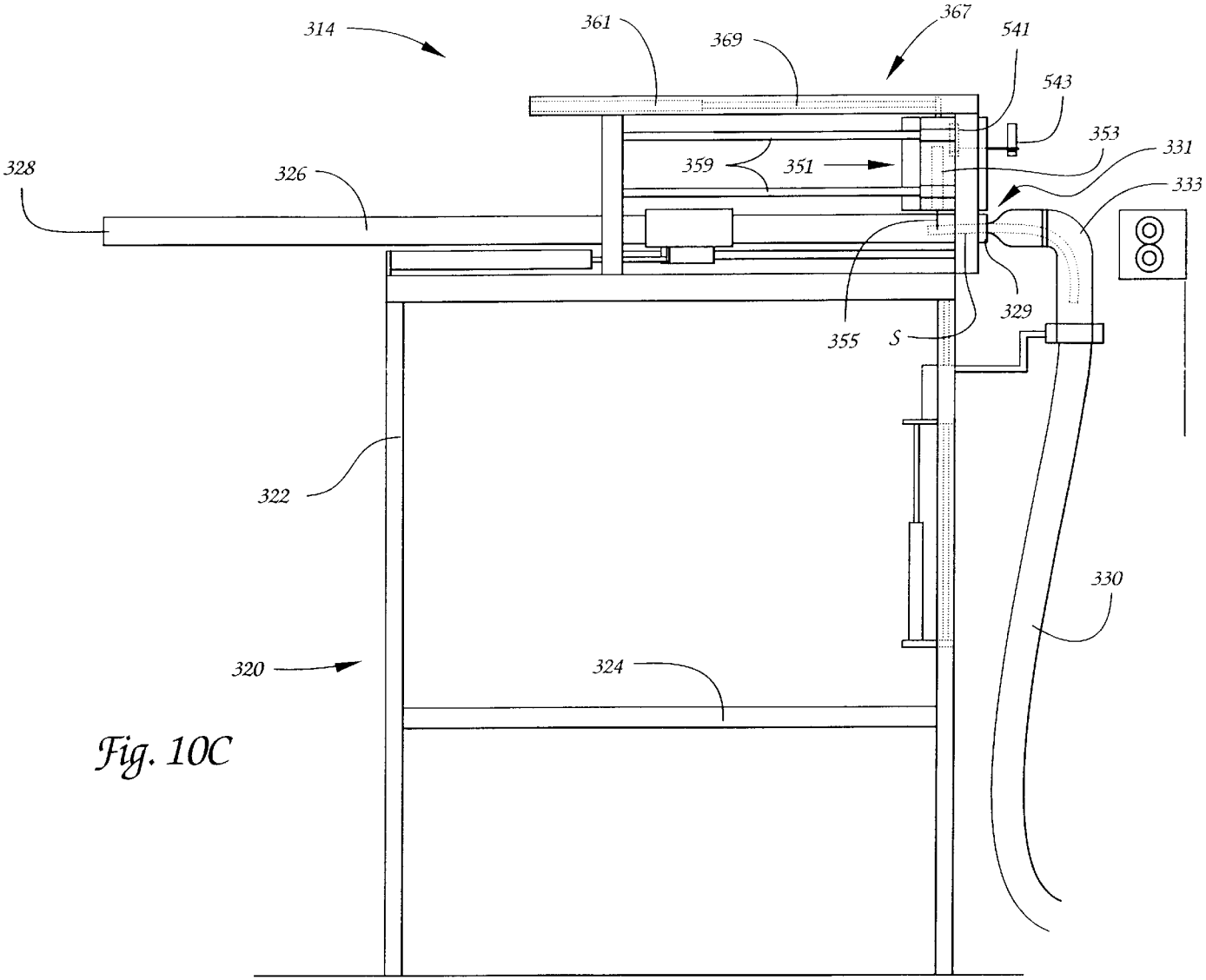
FIG. 10*c* is a side view of the apparatus illustrated in FIG. 10*b* with the sock having activated the first sensor and being pinned to the bottom of the input tube by the plunger.
Figure 10D:
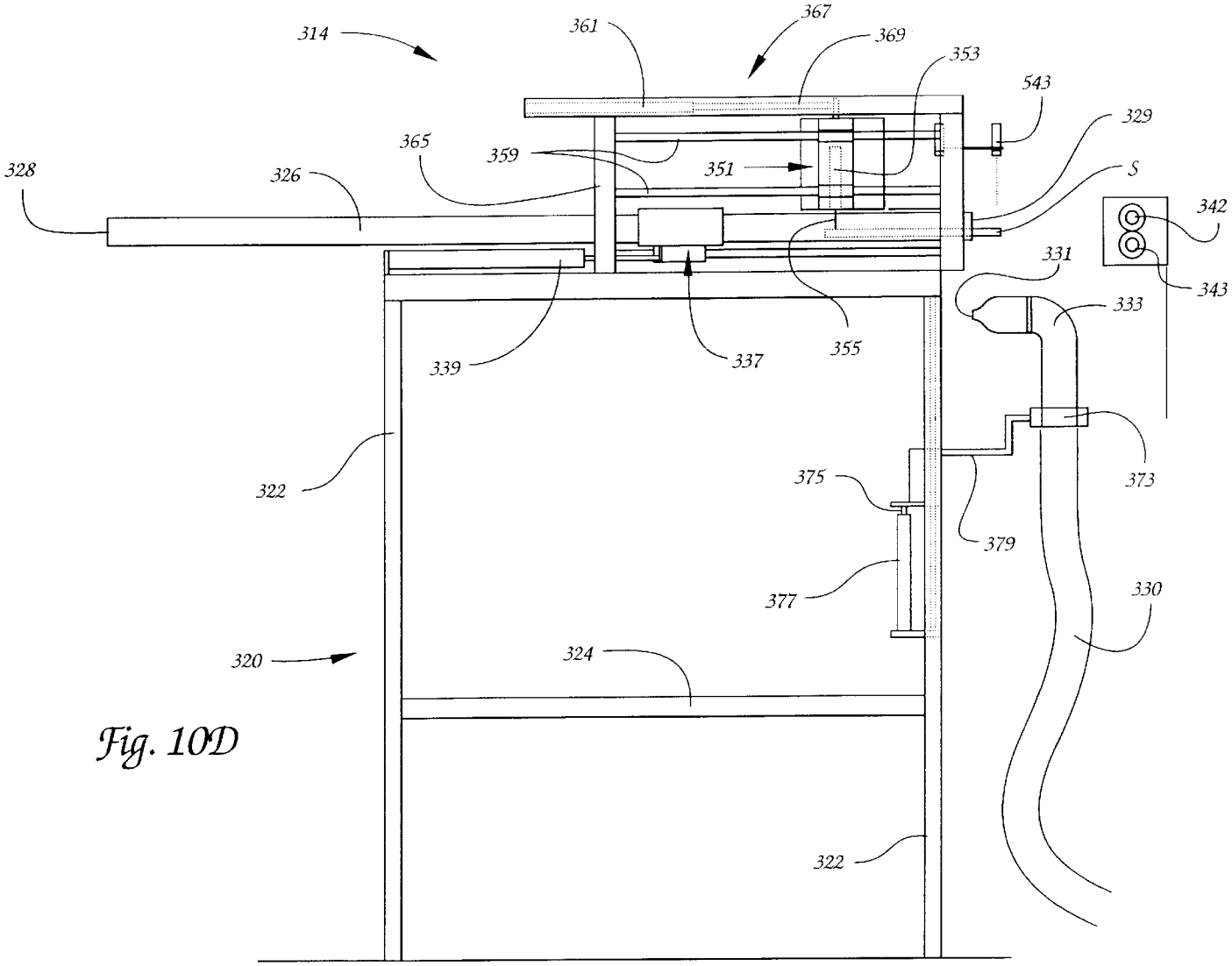
FIG. 10*d* is a side view of the apparatus illustrated in FIG. 10*c* with the sock pinned down by the plunger and being pulled back into the input tube by the horizontal movement of the plunger cylinder away from the exit end and illustrating the vacuum tube at the lowered second, off position.
Figure 10E:
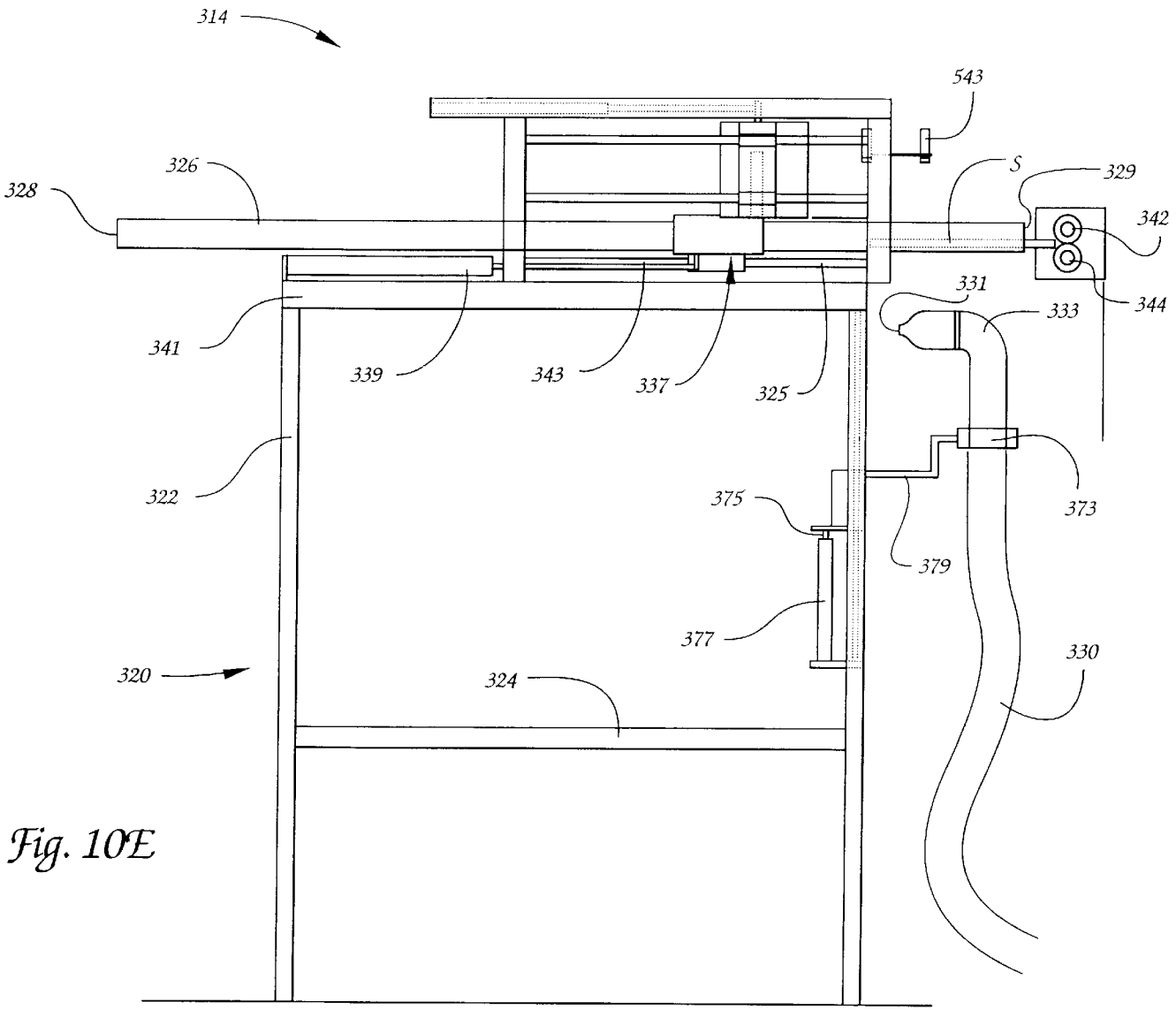
FIG. 10*e* is a side view of the apparatus illustrated in FIG. 10*d* with the sock being released by the retracted plunger and the input tube being moved forward to deliver the sock to the rollers.

In operation, and with references to FIGS. 10*a*–10*e*, and with initial reference to FIG. 10*a*, a sock S is fed into the entrance end 328 of the input tube 326 with a vacuum being applied through the vacuum tube 330 positioned at the exit end 329 and in communication with the vacuum source 345. As shown in 10*a*, the mouth 331 of the vacuum tube 330 is aligned with and placed against the exit end 329 with the vacuum on so that the sock S is rapidly drawn through the input tube 326 to the exit end 329. As the sock S nears the exit end 329 and passes underneath the first sensor 541 as shown in FIG. 10*b*, it is recognized and the microcomputer 270 actuates the piston and cylinder arrangement 353 to move its control rod to active the plunger cylinder 351. With reference to FIG. 10*c*, as the sock S begins to exit the exit end 329 of the input tube 326 and enter the mouth 331 of the vacuum tube 330, the plunger 355 quickly moves from the retracted up position to the extended down position and retains the sock S within the input tube 326. Once the sock S is pinned by the plunger 355, the microcomputer 270 turns off the vacuum and causes and piston and cylinder arrangement 377 to move its piston rod 375 to cause the arm 379 to lower the vacuum tube 330 from the first, operational position to the second, non-operational position leaving the sock S extending slightly outward from the exit end 329 of the input tube 326. Simultaneously, the microcomputer 270 actuates the piston and cylinder arrangement 361 connected to the plunger cylinder 351 and causes it to slide back horizontally toward the entrance end 328, thereby pulling the sock S back into the input tube 326 away from the exit end 329. The plunger cylinder 351 continues to slide back until the sock S reaches a position as it passes underneath the second sensor 543 at which the sock S is no longer detected by the second sensor 543. With reference to FIG. 10*e*, once the second sensor 543 senses the absence of sock S thereunder, a signal is sent to the microcomputer 270 to retract the plunger 355 and actuate the piston and cylinder arrangement 339 to move its control rod 343 connected to the slider 337 which is attached to the input tube 326 and cause the input tube 326 to move forward until the sock S is placed between nip rolls 342, 344.

As in the first preferred embodiment, the delivery assembly 314 of the second preferred embodiment delivers the one or more socks to a positioning assembly 316 which acts to receive the one or more socks from the delivery assembly and position the one or more socks for engagement by a boarding assembly 318. The positioning assembly 316 and the boarding assembly 318 of the second preferred embodiment, and operation thereof, are substantially similar to the positioning assembly 16 and boarding assembly 18 of the first preferred embodiment. Thus, components of the positioning assembly 316 and boarding assembly 318 of the second preferred embodiment corresponding to the components of the first preferred embodiment shown in FIGS. 1–8 bear like reference numerals but in the 300 series for numerals 10–99 of the first embodiment, in the 400 series for numerals 100–199 and in the 500 series for numerals 200–299. For the sake of simplicity and clarity, only those aspects of the second preferred embodiment which differ from the first preferred embodiment are discussed in detail hereafter.

In the positioning assembly 316, the one or more socks are captured by the nip rolls 342, 344 and moved onto the opening unit 380. The nip rolls 342, 344 of the second preferred embodiment are driven by air motors, one motor for each roll 342 and 344. As in the first preferred embodiment, the nip rolls 342, 344 have a textured surface 346 and act to spread the open portion of the sock as it is advanced through the nip rolls 342, 344 to the opening unit 380. As described with reference to the first preferred embodiment, the one or more socks are opened by the opening unit 380 and moved onto the carrier 398 and to the sock rotating system which rotates the one or more socks into position for receipt of the vertically descending sock board. The carrier 398 is rotated to a vertically extending position and the one or more socks are inflated with air from the air supply. The positioning rolls 426, 438 are activated to move toward one another into contact with the one or more socks disposed on the carrier 398 and rotate to properly position the one or more socks. The position of the sock as it is rotated by the nip rolls 342, 344 is sensed by a photocell 452 mounted to the positioning subframe 370 as shown in FIG. 9. In the second preferred embodiment, air supplied from an air source is directed toward the one or more socks through a tube 301 mounted on the subframe to direct a flow of air which blows the rotating sock until the toe of the sock is positioned over the photocell 452. The positioning of the sock S over the photocell 452 causes the microcomputer to activate the piston and cylinder arrangements 412, 496 causing the sock board 504 to descend into the sock S, thereby boarding the sock S.

In the second preferred embodiment, the boarding assembly 318 includes a plurality of boarding subframes 490 which are formed from vertically extending support members 392 in conjunction with horizontally extending support members 394 and are rotatably positioned for selectively rotating subframe 490 one after another into a position for receiving the sock from the positioning assembly. The subframes 490 are mounted on a base 401 which includes a support member 403 adapted to rotatably support a plurality of subframes 490. The base 401 of the second preferred embodiment is a rotatable tray or carousel driven by a motor which can be selectively activated. While two subframes 490 are shown in FIG. 9, the base 401 will preferably carry eight to twelve subframes 490.

As in the first embodiment, the boarding assembly includes a sock board 504 which is generally L-shaped and includes a horizontally extending support member 508 and a vertically extending support member 506 projecting perpendicularly downward from the horizontally extending support member 508. A generally sock shaped end portion 510 is formed at the distal end of the vertically extending member board 506. Each subframe 490 includes a sock board 304 and as in the first preferred embodiment, the sock board of the second preferred embodiment is mounted to the subframe 490 in a configuration which will allow the sock board to trace a square or rectangular path during boarding operations.

By the above, the present invention provides an apparatus for automatically boarding socks which saves both human labor and time.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. An apparatus for automatically boarding socks comprising:

a skeletal frame formed from a plurality of subframes and defining a path of movement for one or more socks being boarded by said apparatus;

an assembly for boarding one or more socks including at least one boarding subframe forming a portion of said skeletal frame, at least one sock form movably mounted to said boarding subframe, an assembly for moving said at least one sock form to a position along said path of movement for movement of said at least one sock form into one or more socks, thereby boarding said one or more socks;

an assembly for positioning one or more socks for engagement by said at least one sock form, including a positioning subframe forming a portion of said skeletal frame, an assembly for supporting and moving one or more socks into a position for engagement by said at least one sock form mounted to said positioning subframe, an assembly for opening one or more socks mounted to said positioning subframe for disposition of the one or more socks on said assembly for supporting and moving one or more socks into a position for engagement by said at least one sock form, and an assembly for maintaining the one or more socks in an opened condition mounted to said positioning subframe for movement of said at least one sock form into one or more socks, thereby boarding said sock; and an assembly for automatically controlling operation of said apparatus operatively associated with said apparatus and including an arrangement for sensing a position of one or more socks along said path of movement and an arrangement for controlling the operation of said assembly for supporting and moving one or more socks into a position for engagement by said at least one sock form, said assembly for opening the sock, said assembly for maintaining the sock in an opened condition and said assembly for supporting and moving said at least one sock form responsive to input from said arrangement for sensing a position of one or more socks along said path of movement indicating the position of one or more socks disposed along said path of movement thereby causing one or more socks introduced into said assembly for positioning one or more socks for engagement by said at least one sock form to be automatically boarded by said assembly for boarding one or more socks.

2. The apparatus of claim 1 further comprising an assembly for delivering one or more socks from a sock source to said assembly for positioning one or more socks for engagement by said at least one sock form including a delivery subframe forming a portion of said skeletal frame, and an assembly for moving one or more socks from the sock source into a position for engagement by said assembly for positioning one or more socks for engagement by said at least one sock form.

3. The apparatus of claim 2, wherein said assembly for moving one or more socks from the sock source into a position for engagement by said assembly for positioning one or more socks for engagement by said at least one sock form includes a driven, endless conveyor belt.

4. The apparatus of claim 3 further comprising an assembly for engaging one or more socks from the sock source disposed at the beginning of said path of movement and for depositing the one or more socks thereby engaged onto said conveyor belt.

5. The apparatus of claim 4, wherein said assembly for engaging one or more socks from the sock source disposed at the beginning of said path of movement and depositing the one or more socks thereby engaged onto said conveyor belt includes a conduit in communication with at least a portion of said conveyor belt and having a pressure therein that is less than atmospheric pressure for drawing one or more socks from an area of atmospheric pressure and depositing the one or more socks onto said conveyor belt.

6. The apparatus of claim 2 further comprising a pair of driven rolls forming a nip mounted to said skeletal frame along said path of movement for engagement of one or more socks to eject the one or more socks from said assembly for delivering one or more socks from a sock source in a manner for acquisition by said assembly for positioning one or more socks for engagement by said at least one sock form.

7. The apparatus of claim 6, wherein said rolls each include a textured surface for releasable adherence thereto of one or more socks passing through said nip to thereby open the one or more socks releasably adhered thereto.

8. The apparatus of claim 2, wherein said positioning subframe forming a portion of said skeletal frame is disposed closely adjacent said delivery subframe for receiving one or more socks from said assembly for delivering one or more socks from a sock source to said assembly for positioning one or more socks for engagement by said at least one sock form.

9. The apparatus of claim 1, wherein said boarding subframe includes a plurality of vertically extending support members and a plurality of horizontally extending support members attached thereto with at least a portion of said support members defining a support surface, and said assembly for boarding one or more socks includes at least one sock form movably mounted to said boarding subframe, with at least one slider mounted to said at least one sock form for controlled sliding movement of said at least one sock form along said support surface.

10. The apparatus of claim 1, wherein said assembly for moving said at least one sock form to a position along said path of movement for movement of said at least one sock form into one or more socks includes a piston and cylinder arrangement mounted to a vertically extending support member and having a selectively moveable rod emitting from said cylinder and attached to said at least one sock form for controlled vertical movement of said at least one sock form.

11. The apparatus of claim 10 further comprising at least one wheel mounted to said selectively moveable rod in contact with said support surface for rolling contact therewith for stabilizing said at least one sock form during vertical movement thereof.

12. The apparatus of claim 10, wherein said assembly for moving said at least one sock form to a position along said path of movement for movement of said at least one sock form into one or more socks further includes a piston and cylinder arrangement mounted to a horizontally extending support member and having a selectively moveable rod emitting from said cylinder and attached to said at least one slider for controlled horizontal movement of said at least one slider thereby moving said at least one sock form.

13. The apparatus of claim 12, wherein said at least one sock form is disposed on said boarding subframe for driven movement through a predetermined closed path by said piston and cylinder arrangements.

14. The apparatus of claim 1, wherein said assembly for supporting and moving one or more socks into a position for engagement by said at least one sock form includes a sock carrier movably mounted to said positioning subframe for movement between a first position for receiving one or more socks and a second position for engagement of the one or more socks by said at least one sock form.

15. The apparatus of claim 14, wherein said sock carrier is formed as two parallelly extending rectangular support members, each being formed with at least one air passage therethrough, and said assembly for maintaining one or more socks in an opened condition includes an assembly for injecting air into said passages for inflation of one or more socks supported by said carrier to enhance the ability of the one or more socks to accept said at least one sock form.

16. The apparatus of claim 15, wherein said assembly for positioning one or more socks for engagement by said at least one sock form includes a pair of driven rolls movably mounted to said positioning subframe for movement between a first position wherein said rolls are separated from said sock carrier and a second position wherein said rolls are in contact with any sock or socks disposed on said carrier for rotational movement of the one or more socks disposed on said carrier responsive to rotational movement of said rolls.

17. The apparatus of claim 16, wherein each of said rolls includes a textured contact surface for engagement with the one or more socks to enhance the ability of the rolls to impart motion to the one or more socks disposed on the carrier.

18. The apparatus of claim 17 further comprising a platform support frame formed as a portion of said positioning subframe and a platform mounted to said platform support frame for disposition of said platform under said carrier when said carrier is at its second position and said arrangement for sensing a position of one or more socks along said path of movement includes a photocell mounted to said platform to sense the position of one or more socks thereat as being acceptable for entry of said at least one sock form, said photocell emitting a signal to said assembly for automatically controlling operation of said apparatus to cause rotation of said rolls to cease thereby halting rotational movement of the one or more socks disposed on said carrier.

19. The apparatus of claim 1, wherein said assembly for opening one or more socks includes an opening unit slidably mounted to said positioning subframe and having a plurality of outwardly projecting arms for disposal of one or more socks thereon, said arms being movable between a first position wherein said arms are closely adjacent one another and a second position wherein said arms are mutually displaced by a predetermined distance, thereby opening any sock or socks disposed thereon, said opening unit being movable between a first position for receiving one or more socks onto said arms and a second position for deposit of the one or more socks onto said assembly for positioning one or more socks for engagement by said at least one sock form.

20. The apparatus of claim 19, wherein said opening unit includes four outwardly projecting arms arranged in two pairs and includes an arrangement to operatively engage one member of each pair with the other member of that pair including at least one gear mounted to each arm in meshed engagement with one another to cause induced movement of one arm to cause movement of the other paired arm with all arms being arranged for movement away from one another once one or more socks are disposed thereon.

21. The apparatus of claim 1, wherein said assembly for automatically controlling operation of said apparatus includes a preprogrammed microcomputer.

22. The apparatus of claim 21, wherein said arrangement for sensing a position of one or more socks along said path of movement includes a plurality of photocells for production of a signal indicative of the presence of one or more socks along said path of movement, said photocells being mounted to said skeletal frame at predetermined locations along said path of movement and operatively connected to said microcomputer for processing of signals produced by said photocells thereby.

23. The apparatus of claim 1, wherein said arrangement for controlling the operation of said assembly for supporting and moving one or more socks into a position for engagement by said at least one sock form, said assembly for opening one or more socks, said assembly for maintaining one or more socks in an opened condition and said assembly for moving said at least one sock form includes an assembly for responding to the position of one or more socks disposed along said path of movement and operating said assembly for supporting and moving one or more socks into a position for engagement by said at least one sock form, said assembly for opening one or more socks, said assembly for maintaining one or more socks in an opened condition and said assembly for moving said at least one sock form thereby causing one or more socks introduced into said assembly for positioning one or more socks for engagement by said at least one sock form to be automatically boarded by said assembly for boarding one or more socks.

24. An apparatus for automatically boarding socks comprising: a skeletal frame formed from a plurality of subframes and defining a path of movement for one or more socks being boarded by said apparatus; an assembly for boarding one or more socks including a boarding subframe forming a portion of said skeletal frame, said boarding subframe including a plurality of vertically extending support members and a plurality of horizontally extending support members attached thereto with at least a portion of said support members defining a support surface, at least one sock form movably mounted to said boarding subframe, an assembly for moving said at least one sock form to a position along said path of movement for movement of said at least one sock form into one or more socks including at least one slider mounted to said at least one sock form for controlled sliding movement of said at least one sock form along said support surface, and further including a first piston and cylinder arrangement mounted to a horizontally extending support member and having a selectively moveable rod emitting from said cylinder and attached to said at least one slider for controlled horizontal movement of said at least one slider for horizontally moving said at least one sock form and a second piston and cylinder arrangement mounted to a vertically extending support member and having a selectively moveable rod emitting from said cylinder and attached to said at least one sock form for controlled vertical movement of said at least one sock form and into the one or more socks, thereby boarding said one or more socks; an assembly for positioning one or more socks for engagement by said at least one sock form, including a positioning subframe forming a portion of said skeletal frame, an assembly for supporting and moving one or more socks into a position for engagement by said at least one sock form mounted to said positioning subframe and including a sock carrier formed as two parallelly extending rectangular support members, each being formed with at least one air passage therethrough, said sock carrier being movably mounted to said positioning subframe for movement between a first position for receiving one or more socks and a second position for engagement of the one or more socks by said at least one sock form; an assembly for opening one or more socks mounted to said positioning subframe including an opening unit slidably mounted to said positioning subframe and having four outwardly projecting arms for disposal of one or more socks thereon, said arms being movable between a first position wherein said arms are closely adjacent one another and a second position wherein said arms are mutually displaced by a predetermined distance, thereby opening any sock or socks disposed thereon, said opening unit being movable between a first position for receiving one or more socks onto said arms and a second position for deposit of the one or more socks onto said an assembly for positioning one or more socks for engagement by said at least one sock form for disposition of the one or more socks on said assembly for supporting and moving one or more socks into a position for engagement by said at least one sock form; an assembly for maintaining the one or more socks in an opened condition including an assembly for injecting air into said passages for inflation of one or more socks supported by said carrier to enhance the ability of the one or more socks to accept said at least one sock form, said assembly for injecting air being mounted to said positioning subframe; a pair of driven rolls movably mounted to said positioning subframe for movement between a first position wherein said rolls are separated from said sock carrier and a second position wherein said rolls are in contact with any sock or socks disposed on said carrier for rotational movement of the one or more socks disposed on said carrier responsive to rotational movement of said rolls, each of said rolls including a textured contact surface for engagement with the one or more socks to enhance the ability of the rolls to impart motion to the one or more socks disposed on the carrier for enhanced movement of said at least one sock form into one or more socks, thereby boarding said sock; an arrangement for sensing a position of one or more socks along said path of movement including a plurality of photocells for production of a signal indicative of the presence of one or more socks along said path of movement, said photocells being mounted to said skeletal frame at predetermined locations along said path of movement and operatively connected to said microcomputer for processing of signals produced by said photocells thereby indicating the position of one or more socks disposed along said path of movement thereby causing a one or more socks introduced into said assembly for positioning one or more socks for engagement by said at least one sock form to be automatically boarded by said assembly for boarding one or more socks; and a microcomputer operatively associated with said apparatus for automatically controlling operation of said apparatus for controlling the operation of said assembly for supporting and moving one or more socks into a position for engagement by said at least one sock form, said assembly for opening the sock, said assembly for maintaining the sock in an opened condition and said assembly for supporting and moving said at least one sock form responsive to input from said arrangement for sensing a position of one or more socks along said path of movement for automatically boarding one or more socks.

25. The apparatus of claim 24 and further comprising means for delivering one or more socks from a sock source to said assembly for positioning one or more socks for engagement by said at least one sock form including a delivery subframe forming a portion of said skeletal frame disposed closely adjacent said positioning subframe, an assembly for moving one or more socks from the sock source into a position for engagement by said assembly for positioning one or more socks for engagement by said at least one sock form including a driven, endless conveyor belt, and further comprising an assembly for engaging one or more socks from the sock source disposed at the beginning of said path of movement and depositing the one or more socks thereby engaged onto said conveyor belt.

26. The apparatus of claim 25 further comprising a pair of driven rolls forming a nip mounted to said skeletal frame along said path of movement for engagement of one or more socks to eject the one or more socks from said assembly for delivering one or more socks from the sock source in a manner for acquisition by said assembly for positioning one or more socks for engagement by said at least one sock form, said rolls each including a textured surface for releasable adherence thereto of one or more socks passing through said nip to thereby open the one or more socks releasably adhered thereto.

27. The apparatus of claim 2, wherein said assembly for positioning one or more socks for engagement by at least one sock form comprises an input tube having an entrance end for receiving one or more socks into said input tube and an exit end for discharging one or more socks from said input tube; and means for lowering the atmospheric pressure within said input tube for rapidly drawing said one or more socks from said entrance end through said input tube to said exit end.

28. The apparatus of claim 27, wherein said means comprises a vacuum tube positioned adjacent to said exit end and in communication with a vacuum source for drawing one or more socks through said tube to said exit end.

29. The apparatus of claim 27, wherein said input tube is slidably mounted to said delivery subframe for selectively moving said input tube in a horizontal direction.

30. The apparatus of claim 29 further comprising a piston and cylinder arrangement horizontally mounted to said delivery frame, said piston and cylinder arrangement comprising a selectively extendable piston rod and at least one slider connecting said piston rod to said input tube for controlling horizontal movement of said input tube.

31. The apparatus of claim 28, wherein said vacuum tube is moveable between a first, operational position and a second, non-operational position.

32. The apparatus of claim 31, wherein said vacuum tube includes a vacuum mouth disposed to be aligned with said exit end when said vacuum tube is in said first, operational position for creating a vacuum within said input tube and to be out of alignment with said input tube when said input tube is in said second, non-operational position.

33. The apparatus of claim 31 further comprising a piston and cylinder arrangement vertically mounted to said delivery frame, said piston and cylinder arrangement comprising a selectively extendable piston rod and an arm connecting said piston rod to said vacuum tube for controlling vertical movement of said vacuum tube from said first, operation position to said second, non-operational position.

34. The apparatus of claim 27 further comprising an assembly for engaging and retaining one or more socks disposed at said exit end.

35. The apparatus of claim 34, wherein said assembly for engaging and retaining one or more socks includes a stop member positioned adjacent said exit end for preventing said one or more socks from being discharged from said input tube at said exit end.

36. The apparatus of claim 35, wherein said assembly includes at least one piston and cylinder arrangement for moving said stop member into position for engaging and retaining said one or more socks.

37. The apparatus of claim 35, wherein said stop member comprises a plunger cylinder having a plunger moveably attached thereto, said plunger being moveable between a retracted position and an extended position for engaging and retaining one or more socks in said extended position.

38. The apparatus of claim 37, wherein said stop member further includes a piston and cylinder arrangement vertically mounted within said plunger cylinder and having a selectively extendable piston rod attached to said plunger for controlling vertical movement of said plunger between said retracted position and said extended position.

39. The apparatus of claim 37 further comprising an upper subframe mounted to said delivery subframe and a piston and cylinder arrangement horizontally mounted to said upper subframe, said piston and cylinder arrangement comprising a selectively extendable piston rod and at least one slider connecting said piston rod to said plunger cylinder for controlling horizontal movement of said plunger cylinder.

40. The apparatus of claim 30 further comprising at least one sensor disposed at said exit end for sensing movement of one or more socks and actuating said piston and cylinder arrangement.

41. The apparatus of claim 33 further comprising at least one sensor disposed at said exit end for sensing movement of one or more socks and actuating said piston and cylinder arrangement.

42. The apparatus of claim 36 further comprising at least one sensor disposed at said exit end for sensing movement of one or more socks and actuating said piston and cylinder arrangement.

43. The apparatus of claim 27 further comprising a pair of sensors disposed at said exit end for sensing movement of one of more socks.

44. The apparatus of claim 39 further comprising a first sensor immediately adjacent said exit end for production of a signal indicative of the presence of one or more socks along said path of movement and for causing said plunger to be moved from said retracted position to said extended position for retaining said one or more socks within said input tube.

45. The apparatus of claim 44, wherein said first sensor is mounted at a predetermined location on said upper subframe.

46. The apparatus of claim 44, wherein said first sensor actuates said piston and cylinder arrangement for causing said plunger cylinder to slide horizontally away from said exit end thereby pulling one or more of said socks retained within said input tube by said plunger.

47. The apparatus of claim 33 further comprising a first sensor immediately adjacent to said exit end for production of a signal indicative of the presence of one or more socks along said path of movement and for actuating said piston and cylinder arrangement causing said vacuum tube to move vertically from said first, operational position to said second, non-operational position.

48. The apparatus of claim 47 wherein said sensor further causes said vacuum source to be removed.

49. The apparatus of claim 39 further comprising a second sensor positioned immediately adjacent said exit end for production of a signal indicative of the absence of one or more socks.

50. The apparatus of claim 49, wherein said second sensor is mounted at a predetermined location extending outward from said upper subframe.

51. The apparatus of claim 30 further comprising a second sensor positioned immediately adjacent said exit end for production of a signal indicative of the absence of one or more socks for actuating said piston and cylinder arrangement to move said input tube forward for discharging said one or more socks from said input tube.

52. The apparatus of claim 17 further comprising a means for providing a flow of air directed at said carrier for positioning said one or more socks for engagement by said at least one sock form.

53. The apparatus of claim 1, wherein said assembly for boarding one or more socks includes a plurality of boarding subframes each having at least one sock form and said assembly for boarding includes a base for rotatably supporting said subframes for rotating said subframes into position for moving said sock form of each subframe into one or more socks.

* * * * *